US012624519B2

(12) United States Patent
Okada et al.

(10) Patent No.: US 12,624,519 B2
(45) Date of Patent: May 12, 2026

(54) SHOVEL

(71) Applicant: SUMITOMO HEAVY INDUSTRIES, LTD., Tokyo (JP)

(72) Inventors: Junichi Okada, Kanagawa (JP); Keiji Honda, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 597 days.

(21) Appl. No.: 17/212,043

(22) Filed: Mar. 25, 2021

(65) Prior Publication Data

US 2021/0230829 A1 Jul. 29, 2021

Related U.S. Application Data

(63) Continuation of application No. PCT/JP2019/037932, filed on Sep. 26, 2019.

(30) Foreign Application Priority Data

Sep. 27, 2018 (JP) ..... 2018-181988
Oct. 3, 2018 (JP) ..... 2018-188453

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/22*** | (2006.01) |
| ***E02F 9/24*** | (2006.01) |

(52) U.S. Cl.

CPC ..... *E02F 3/439* (2013.01); *E02F 3/32* (2013.01); *E02F 9/2041* (2013.01); *E02F 9/2228* (2013.01); *E02F 9/24* (2013.01); *E02F 9/2267* (2013.01); *E02F 9/2271* (2013.01); *E02F 9/2285* (2013.01); *E02F 9/2292* (2013.01); *E02F 9/2296* (2013.01)

(58) Field of Classification Search

None

See application file for complete search history.

(56) References Cited

U.S. PATENT DOCUMENTS

| | | | | |
|---|---|---|---|---|
| 10,041,225 | B2 | 8/2018 | Mizuochi et al. | |
| 10,392,782 | B2 * | 8/2019 | Jeon | E02F 9/2285 |
| 2019/0218746 | A1 | 7/2019 | Okada et al. | |
| 2020/0131737 | A1 * | 4/2020 | Suzuki | E02F 9/2214 |
| 2020/0224384 | A1 * | 7/2020 | Suzuki | E02F 3/435 |

(Continued)

FOREIGN PATENT DOCUMENTS

| | | |
|---|---|---|
| JP | H07-180192 | 7/1995 |
| JP | H09-088126 | 3/1997 |

(Continued)

OTHER PUBLICATIONS

International Search Report for PCT/JP2019/037932 mailed on Dec. 10, 2019.

*Primary Examiner* — Lail A Kleinman
(74) *Attorney, Agent, or Firm* — IPUSA, PLLC

(57) ABSTRACT

A shovel includes a lower traveling body, an upper turning body turnably mounted on the lower traveling body, an attachment including a boom attached to the upper turning body, an arm attached to an end of the boom, and an end attachment attached to an end of the arm, wherein a motion of the arm or the end attachment is corrected according to a stability of a body of the shovel.

20 Claims, 17 Drawing Sheets

(56) References Cited

U.S. PATENT DOCUMENTS

| | | | | |
|---|---|---|---|---|
| 2021/0047808 | A1* | 2/2021 | Yamada | E02F 9/268 |
| 2021/0123213 | A1* | 4/2021 | Maekawa | E02F 9/2282 |
| 2021/0340720 | A1* | 11/2021 | Takahashi | E02F 9/2221 |

FOREIGN PATENT DOCUMENTS

| | | |
|---|---|---|
| JP | 2000-104290 | 4/2000 |
| JP | 2015-067994 | 4/2015 |
| JP | 2016-169572 | 9/2016 |
| JP | 2017-179929 | 10/2017 |
| JP | 2018-091131 | 6/2018 |
| WO | 2018/062210 | 4/2018 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2019/037932, filed on Sep. 26, 2019, and designating the U.S., which claims priority to Japanese Patent Application No. 2018-181988 filed on Sep. 27, 2018, and Japanese Patent Application No. 2018-188453 filed on Oct. 3, 2018. The entire contents of the foregoing applications are incorporated herein by reference.

BACKGROUND

Technical Field

The present disclosure relates to a shovel.

Description of Related Art

For example, during an excavation operation and the like, a technique for alleviating a predetermined unstable phenomenon such as lifting up and the like of a rear part that occurs with the body of the shovel is known.

SUMMARY

According to an aspect of the present disclosure, provided is a shovel including a lower traveling body, an upper turning body turnably mounted on the lower traveling body, an attachment including a boom attached to the upper turning body, an arm attached to an end of the boom, and an end attachment attached to an end of the arm, wherein a motion of the arm or the end attachment is corrected according to a stability of a body of the shovel.

EMBODIMENT OF THE INVENTION

For example, during an excavation operation and the like, a technique for alleviating a predetermined unstable phenomenon such as lifting up and the like of a rear part that occurs with the body of the shovel is known.

However, when an attachment is in the air (hereinafter referred to as "during aerial motion of attachment"), an unstable phenomenon such as lifting up and the like of the rear part may occur in the body of the shovel according to the motion of the shovel.

Therefore, in view of the above circumstances, it is desired to provide a shovel capable of alleviating an unstable phenomenon that could occur with the body of the shovel during aerial motion of the attachment.

Hereinafter, an embodiment for carrying out the invention is described with reference to the drawings.

[Overview of Shovel]

First, an overview of a shovel 100 according to the present embodiment will be explained with reference to FIG. 1.

Figure 1:
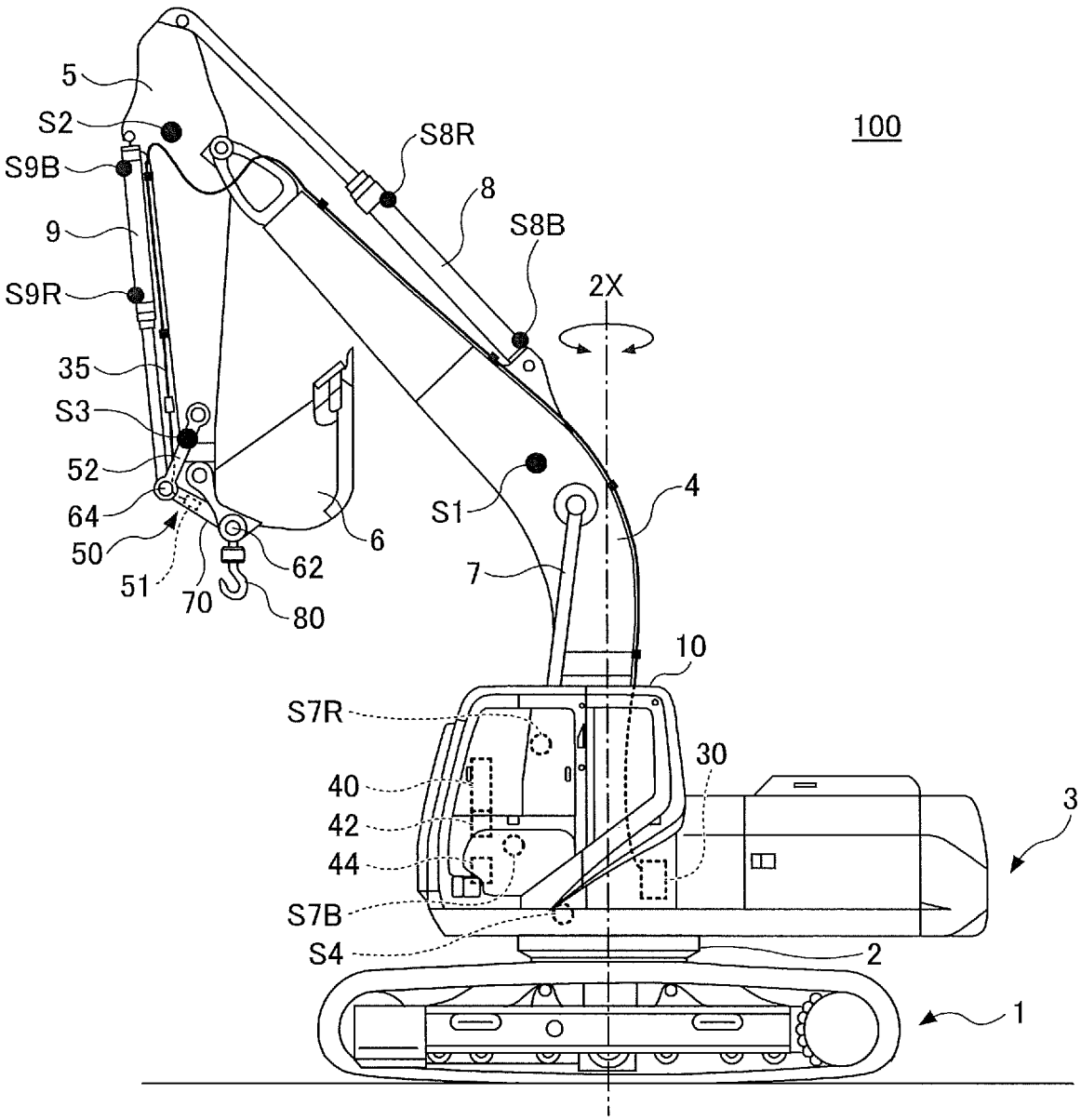
FIG. 1 is a side view illustrating an example of a shovel.

FIG. 1 is a side view of the shovel 100 according to the present embodiment.

The shovel 100 according to the present embodiment includes a lower traveling body 1, an upper turning body 3 mounted on the lower traveling body 1 turnably with a turn mechanism 2, a boom 4 (an example of a "work attachment"), an arm 5, a bucket 6, and a cab 10 in which an operator rides. Hereinafter, a front side of the shovel 100 corresponds to a direction in which an attachment extends with reference to the upper turning body 3 (hereinafter simply referred to as a "direction in which the attachment extends") when the shovel 100 is seen in a plan view as seen from immediately above along the turning axis of the upper turning body 3 (hereinafter simply referred to as a "plan view"). The left-hand side and the right-hand side of the shovel 100 correspond to the left-hand side and the right-hand side, respectively, of the operator in the cab 10 when the shovel 100 is seen in the plan view.

The lower traveling body 1 includes, for example, a pair of right and left crawlers. The crawlers are hydraulically driven by traveling hydraulic motors 1L, 1R (see FIG. 2 to FIG. 4) to cause the shovel 100 to travel.

The upper turning body 3 is driven by a turning hydraulic motor 2A (see FIG. 2 to FIG. 4) to turn with reference to the lower traveling body 1.

The boom 4 is pivotally attached to the front center of the upper turning body 3 to be able to vertically pivot. The arm 5 is pivotally attached to the end of the boom 4 to be able to pivot vertically. The bucket 6 is pivotally attached to the end of the arm 5 to be able to vertically pivot. The boom 4, the arm 5, and the bucket 6 are hydraulically driven by a boom cylinder 7, an arm cylinder 8, and a bucket cylinder 9, respectively, serving as hydraulic actuators.

Also, a hook 80 for crane operation is attached to the bucket 6. The proximal end of the hook 80 is rotatably coupled to a bucket pin 62 connecting the arm 5 and the bucket 6. Therefore, in a case where operations other than the crane operation, such as an excavation operation and the like, is performed, the hook 80 is retracted in a hook container 50 formed between two bucket links 70.

The bucket 6 is an example of an end attachment. The shovel 100 may be attached with end attachments of types different from the bucket 6 (end attachments of purposes different from the bucket 6, such as a rock drill and a lifting magnet, and end attachments of the same purpose as the bucket 6 but of different specification from the bucket 6, such as a large bucket). In other words, according to the contents of the operations and the like, the shovel 100 may be configured such that the types of the end attachments are replaceable as appropriate.

The cab 10 is an operation room in which the operator rides, and is mounted on the front left of the upper turning body 3.

In accordance with operations performed by an operator (hereinafter referred to as an "on-board operator" for the sake of convenience) who rides the cab 10, the shovel 100 operates driven elements such as the lower traveling body 1, the upper turning body 3, the boom 4, the arm 5, the bucket 6, and the like.

Also, the shovel 100 may move motion elements (driven elements) such as the lower traveling body 1, the upper turning body 3, the boom 4, the arm 5, the bucket 6, and the like according to remote operation signals received from a predetermined external device (for example, a management apparatus 200 explained later). In other words, the shovel 100 may be remotely operated. When the shovel 100 is remotely operated, the cab 10 may be unmanned.

Also, the shovel 100 may automatically operate hydraulic actuators regardless of the contents of operations of the on-board operator in the cab 10 or remote operations of an operator with the external device (hereinafter referred to as a "remote operator" for the sake of convenience). Accordingly, the shovel 100 achieves a function for automatically operating at least some of the driven elements of the lower traveling body 1, the upper turning body 3, the boom 4, the arm 5, the bucket 6, and the like (hereinafter referred to as an "automatic drive function"). Hereinafter, the on-board operator and the remote operator may be collectively referred to as an operator.

The automatic drive function may include a function (what is termed as a "semi-automatic drive function") for automatically operating driven elements (hydraulic actuators) other than a driven element (a hydraulic actuator) that is to be operated according to the operations of the on-board operator and the remote operations of the remote operation operator. Also, the automatic drive function may include a function (what is termed as a "full-automatic drive function") for automatically operating at least some of the multiple driven elements (hydraulic actuators) under the assumption that operations of the on-board operator and remote operation of the remote operator are not performed. In the shovel 100, in the case where the full-automatic drive function is activated, the cab 10 may be unmanned. Also, the automatic drive function may include a function (a "gesture operation function") in which the shovel 100 recognizes a gesture of a person such as a worker and the like around the shovel 100, and according to the contents of the recognized gesture, at least some of the multiple driven elements (hydraulic actuators) are automatically operated. Also, the semi-automatic drive function, the full-automatic drive function, and the gesture operation function may include an aspect in which operation contents of the driven element (the hydraulic actuator) that is to be automatically driven are automatically determined according to a rule defined in advance. Also, the semi-automatic drive function, the full-automatic drive function, and the gesture operation function may include an aspect (what is termed as an "autonomous driving function") in which the shovel 100 autonomously makes various kinds of determinations, and may, according to the determination result, autonomously determine operation contents of driven elements (hydraulic actuators) that are to be automatically driven.

Example of Shovel

Subsequently, an example of the shovel 100 is explained.

<Configuration of Shovel>

With reference to not only FIG. 1 but also FIG. 2 to FIG. 5, a specific configuration of the shovel 100 is explained.

Figure 2:
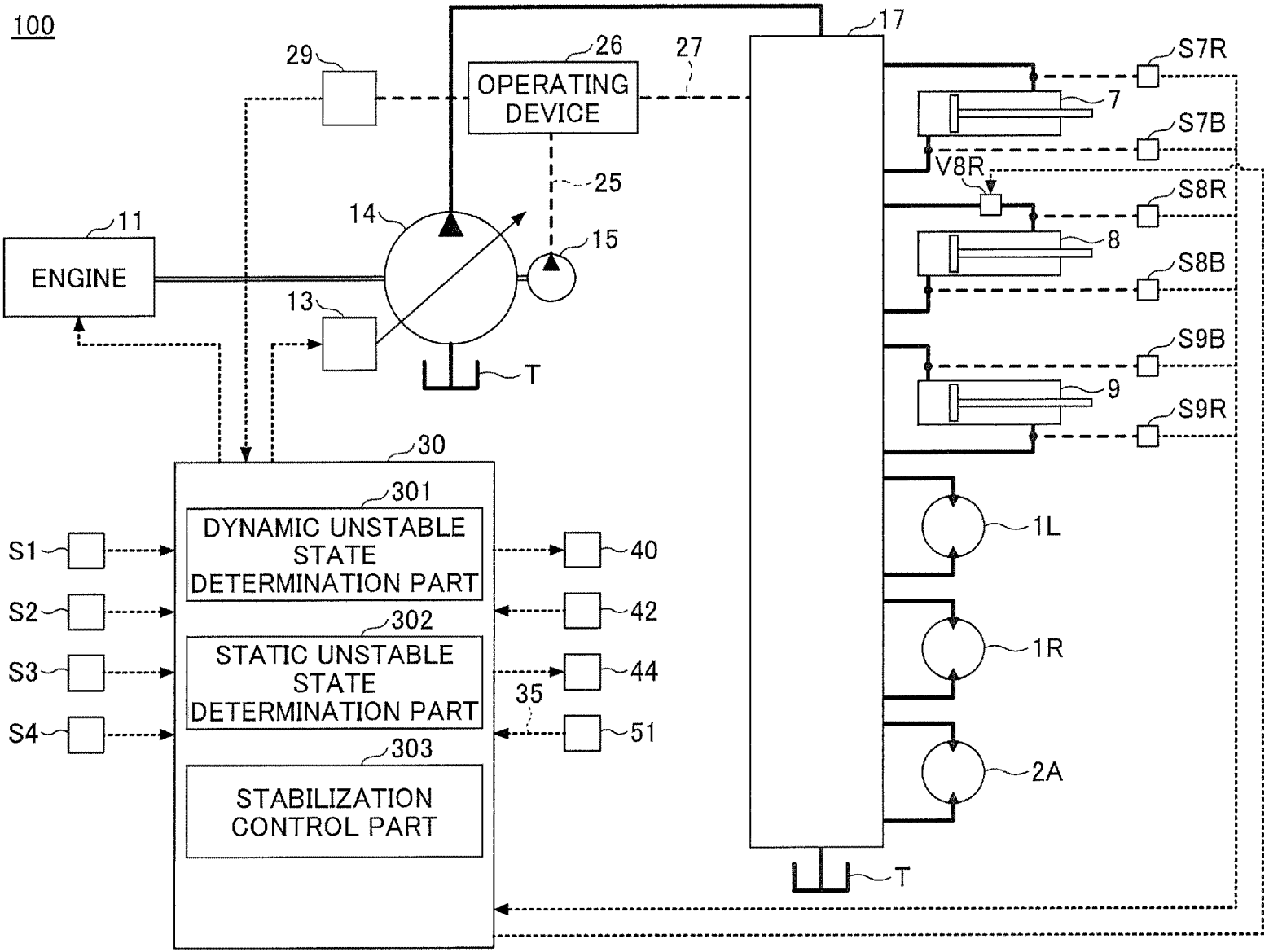
FIG. 2 is a block diagram illustrating a first example of a configuration of a shovel.
Figure 3:
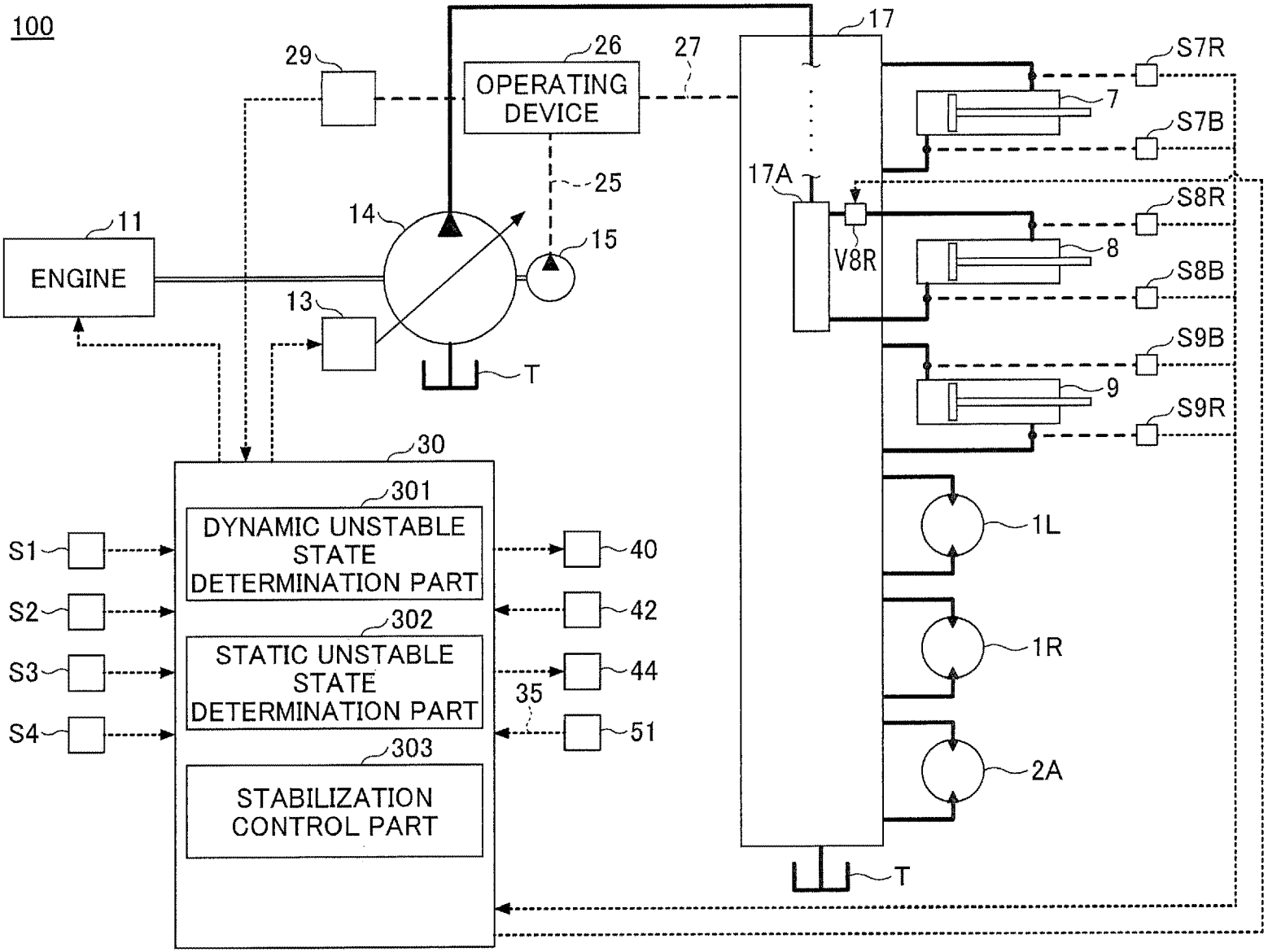
FIG. 3 is a block diagram illustrating a second example of a configuration of a shovel.
Figure 4:
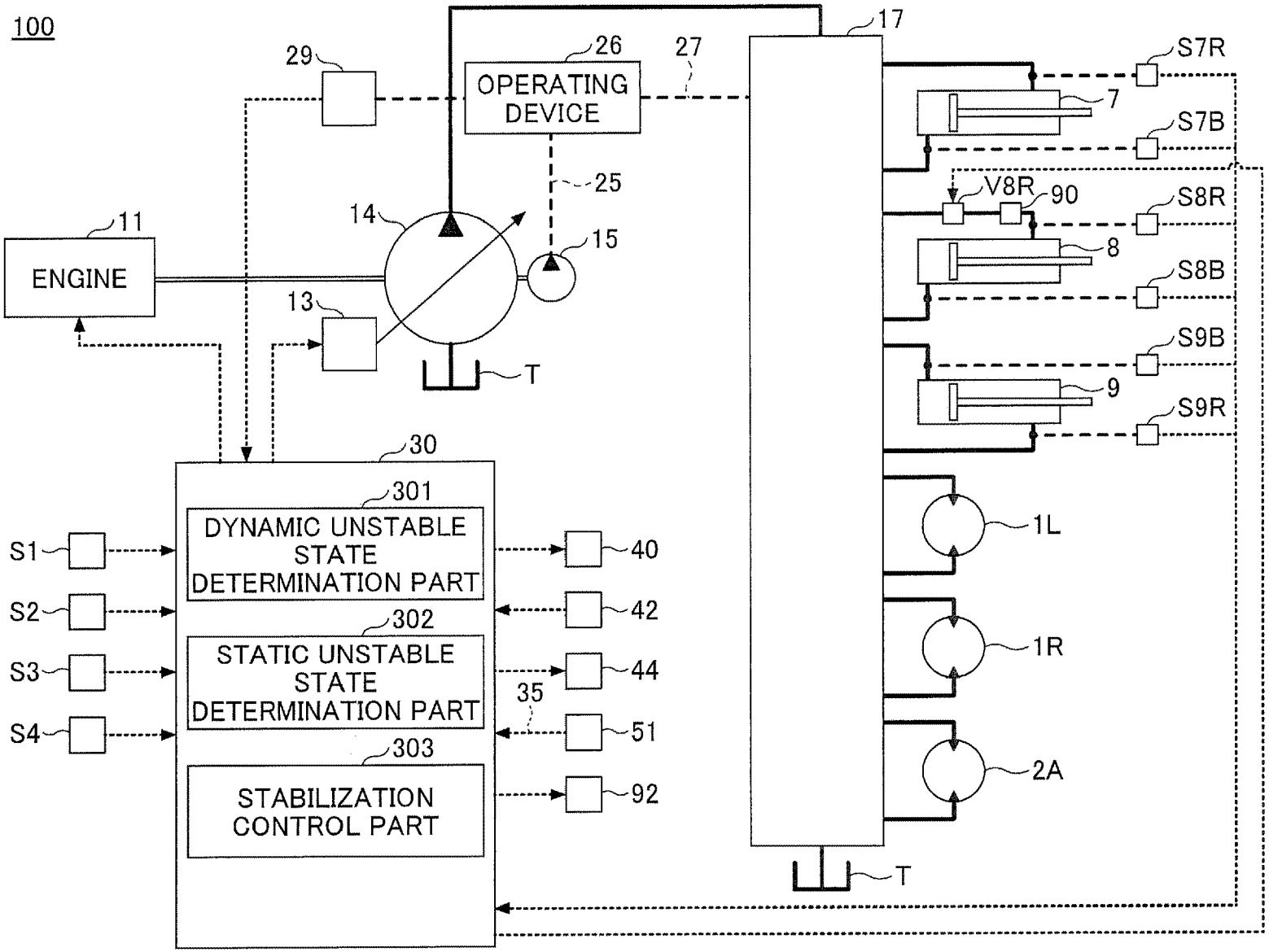
FIG. 4 is a block diagram illustrating a third example of a configuration of a shovel.
Figure 5:
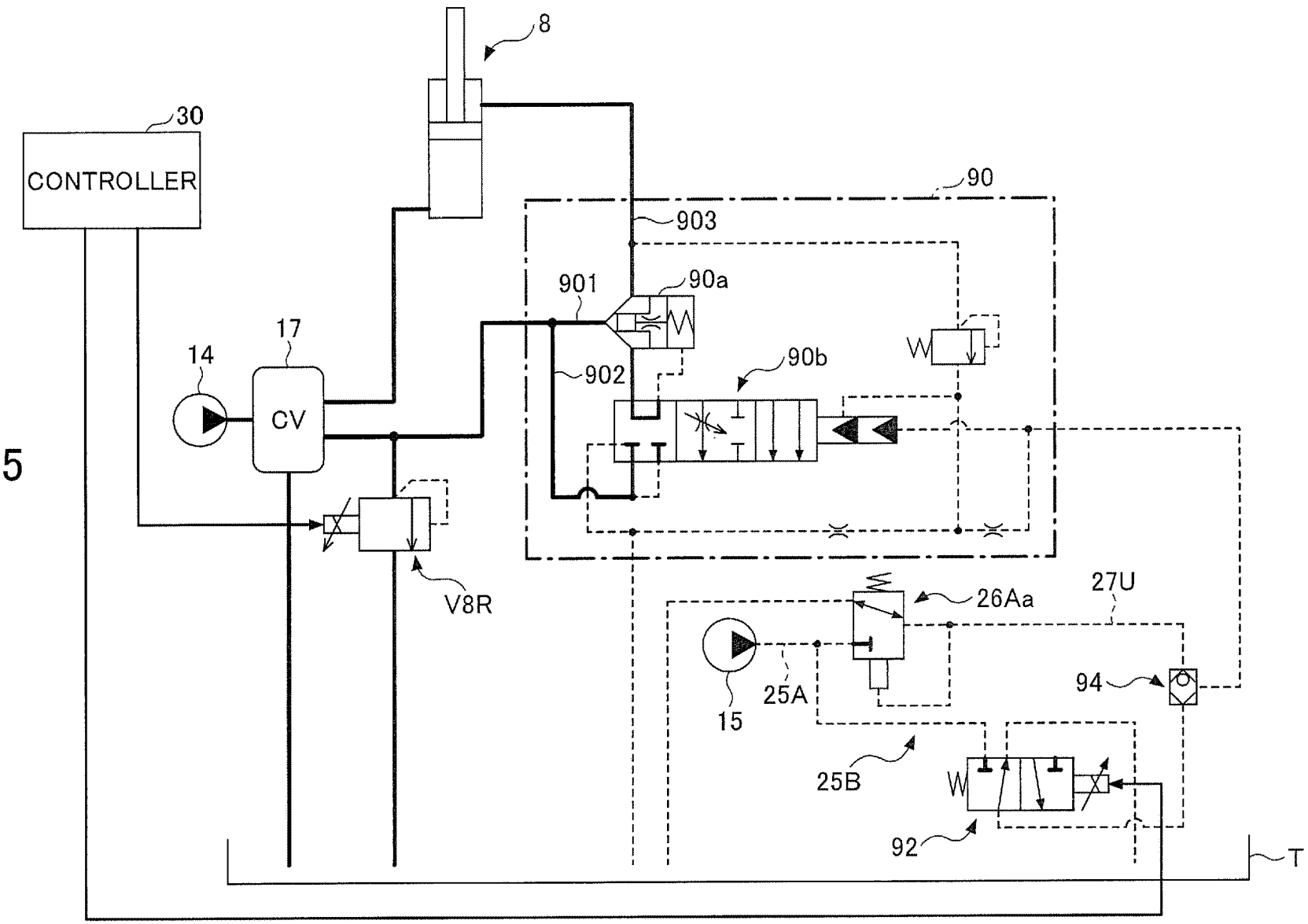
FIG. 5 is a diagram illustrating an example of a hydraulic circuit including a hydraulic oil holding circuit and a relief valve in detail.

FIG. 2 to FIG. 4 are blocks illustrating a first example to a third example of configurations of the shovel 100 according to the present embodiment. Specifically, FIG. 2 to FIG. 4 are different from each other in the configuration of the hydraulic circuit related to a relief valve V8R. FIG. 5 is a diagram illustrating an example of a hydraulic circuit including a hydraulic oil holding circuit 90 and the relief valve V8R. Specifically, FIG. 5 is a diagram illustrating an example of the hydraulic circuit including the hydraulic oil holding circuit 90 and the relief valve V8R corresponding to the configuration of the shovel 100 as illustrated in FIG. 4.

In FIG. 2 to FIG. 4, a mechanical power line, a high-pressure hydraulic line, a pilot line, and an electric drive and control system are indicated by a double line, a thick solid line, a dashed line, and a dotted line, respectively.

As described above, the hydraulic driving system of the shovel 100 according to the present example includes hydraulic actuators such as the traveling hydraulic motors 1L, 1R, the turning hydraulic motor 2A, the boom cylinder 7, the arm cylinder 8, the bucket cylinder 9, and the like hydraulically driving the lower traveling body 1, the upper turning body 3, the boom 4, the arm 5, and the bucket 6, and the like, respectively. Also, the hydraulic driving system of the shovel 100 according to the present embodiment includes an engine 11, a regulator 13, a main pump 14, and a control valve 17.

The engine 11 is a main power source in the hydraulic drive system, and is mounted on the rear part of the upper turning body 3, for example. Specifically, under direct or indirect control by a controller 30 explained later, the engine 11 rotates constantly at a preset target rotational speed, and drives the main pump 14 and a pilot pump 15. The engine 11 is, for example, a diesel engine using light oil as fuel.

The regulator 13 controls the amount of discharge of the main pump 14. For example, the regulator 13 adjusts the angle (hereinafter referred to as a "tilt angle") of a swashplate of the main pump 14 according to a control instruction given by the controller 30.

The main pump 14 is mounted, for example, on the rear part of the upper turning body 3, similarly with the engine 11, and supplies hydraulic oil to the control valve 17 through a high-pressure hydraulic line 16. The main pump 14 is driven by the engine 11 as described above. The main pump 14 is, for example, a variable displacement hydraulic pump, in which the regulator 13 controls the tilt angle of the swashplate to adjust the stroke length of a piston under the control performed by the controller 30 as described above, so that the discharge flowrate (discharge pressure) can be controlled.

The control valve 17 is a hydraulic control device that is installed, for example, at the center of the upper turning body 3, and that controls the hydraulic drive system according to the on-board operator's operations of an operating device 26 or the remote operator's remote operations. The control valve 17 is connected to the main pump 14 via the high-pressure hydraulic line 16 as described above, and hydraulic oil supplied from the main pump 14 is selectively supplied to the hydraulic actuators (i.e., the traveling hydraulic motors 1L, 1R, the turning hydraulic motor 2A, the boom cylinder 7, the arm cylinder 8, and the bucket cylinder 9) according to the operator's operation contents. Specifically, the control valve 17 includes multiple control valves (for example, a control valve 17A, explained later, corresponding to the arm cylinder 8) that control the flowrates and the flow directions of hydraulic oil supplied from the main pump 14 to the respective hydraulic actuators.

The operation system of the shovel 100 according to the present embodiment includes the pilot pump 15 and the operating device 26.

The pilot pump 15 is installed, for example, on the rear part of the upper turning body 3, and applies a pilot pressure to the operating device 26 via a pilot line 25. For example, the pilot pump 15 is a fixed displacement hydraulic pump, and is driven by the engine 11 as described above.

The operating device 26 is provided near the operator's seat of the cab 10, and is operation input means allowing the operator to operate the motion elements (such as the lower traveling body 1, the upper turning body 3, the boom 4, the arm 5, and the bucket 6). In other words, the operating device 26 is operation input means with which the operator operates the hydraulic actuators (i.e., the traveling hydraulic motors 1L, 1R, the turning hydraulic motor 2A, the boom cylinder 7, the arm cylinder 8, the bucket cylinder 9, and the like) for driving the respective motion elements.

As illustrated in FIG. 2 to FIG. 4, for example, the operating device 26 is a hydraulic pilot type that uses hydraulic oil supplied from the pilot pump 15 through the pilot line 25. The operating device 26 uses the hydraulic oil supplied from the main pump 14 to output the pilot pressure according to the operation contents to a pilot line 27 on its secondary side. The operating device 26 is connected to the control valve 17 through the pilot line 27 on its secondary side. Accordingly, the control valve 17 receives a pilot pressure corresponding to the motion state of each of the lower traveling body 1, the upper turning body 3, the boom 4, the arm 5, the bucket 6, and the like from the operating device 26. Accordingly, the control valve 17 can achieve the motion of each of the hydraulic actuators according to the motion state of the operating device 26.

Also, for example, the operating device 26 may be an electric type outputting an electric signal (hereinafter referred to as an "operation signal") according to the operation contents. For example, the operation signals that are output from the operating device 26 are input to the controller 30. Accordingly, according to the received operation signal, the controller 30 outputs a control instruction according to the operation contents of the operating device 26 to a hydraulic control valve (hereinafter referred to as an "operational control valve") interposed in a pilot line connecting the pilot pump 15 and the pilot port of the control valve 17. Accordingly, the pilot pressure according to the operation contents of the operating device 26 is supplied from the operational control valve to the control valve 17. Therefore, the control valve 17 can achieve the motion of each of the hydraulic actuators according to the operation contents on the operating device 26 by the on-board operator and the like.

Note that, even in a case where the shovel 100 is remotely operated, the operational control valve may be used. For example, the controller 30 outputs a control instruction according to the contents of remote operations to the operational control valve, according to a remote operation signal received from an external device. Accordingly, the pilot pressure according to the contents of remote operations is supplied from the operational control valve to the control valve 17. Therefore, the control valve 17 can achieve the motion of each of the hydraulic actuators according to the contents of remote operations by the remote operator. Also, even in a case where the shovel 100 has the automatic drive function, the operational control valve may be used. For example, regardless of operator's operations, the controller 30 outputs control instructions corresponding to the motions of the hydraulic actuators achieved with the automatic drive function. Accordingly, the pilot pressures according to the motions of the hydraulic actuators with the automatic drive function are supplied from the operational control valve to the control valve 17. Therefore, the control valve 17 can achieve the motion of each of the hydraulic actuators corresponding to the automatic drive function.

For example, the operating device 26 includes lever devices operating the boom 4 (the boom cylinder 7), the arm 5 (the arm cylinder 8), the bucket 6 (the bucket cylinder 9), and the upper turning body 3 (the turning hydraulic motor 2A). Also, for example, the operating device 26 includes pedal devices or lever devices for operating left and right lower traveling body 1 (the travelling hydraulic motors 1L, 1R).

The control system of the shovel 100 according to the present embodiment includes the controller 30, an operation pressure sensor 29, a display 40, an input device 42, a sound output device 44, a hook containing state detection device 51, a boom angle sensor S1, an arm angle sensor S2, a bucket angle sensor S3, a body angle sensor S4, a boom bottom pressure sensor S7B, a boom rod pressure sensor S7R, an arm bottom pressure sensor S8B, an arm rod pressure sensor S8R, a bucket bottom pressure sensor S9B, a bucket rod pressure sensor S9R, and the relief valve V8R.

The controller 30 performs drive control of the shovel 100. The functions of the controller 30 may be achieved by any given hardware, a combination of hardware and software, and the like. For example, the controller 30 is mainly constituted by a computer including a CPU (Central Processing Unit), a memory device such as a RAM (Random Access Memory), a nonvolatile auxiliary storage device such as a ROM (Read Only Memory), and various kinds of input and output interface devices, and the like. For example, the controller 30 includes a dynamic unstable state determination part 301, a static unstable state determination part 302, and a stabilization control part 303, as functional parts achieved by causing a CPU to execute one or more programs installed on the auxiliary storage device and the like.

Note that some of the functions of the controller 30 may be achieved by other controllers (control devices). The function of the controller 30 may be achieved as being distributed across multiple controllers.

As described above, the operation pressure sensor 29 detects the secondary-side (the pilot line 27) pilot pressure of the operating device 26, i.e., the pilot pressure corresponding to the motion state of the operating device 26 for each motion element (i.e., each hydraulic actuator). The detection signal of the pilot pressure corresponding to the motion state of the operating device 26 detected by the operation pressure sensor 29 with respect to the lower traveling body 1, the upper turning body 3, the boom 4, the arm 5, the bucket 6, and the like is input to the controller 30.

The display 40 is provided at a position in the cab 10 where the operator can easily see the display 40, and is configured to display various kinds of information images under the control of the controller 30. The display 40 is, for example, a liquid crystal display, an organic EL (Electroluminescence) display, and the like.

The input device 42 is provided in an area that can be reached by the operator who is seated in the cab 10, and is configured to receive various kinds of operation inputs from the operator, and to output a signal according to the operation inputs to the controller 30. The input device 42 includes, for example: a touch panel implemented on a display of a display for displaying various kinds of information images; knob switches provided at the ends of the levers of the lever devices included in the operating device 26; and button switches, levers, toggle switches, dials, and the like provided around the display 40; a touch panel implemented on the display 40; a touch pad provided separately from the display 40; and the like.

For example, the input device 42 may include a crane mode switch for receiving an operation input from the operator and the like for switching the motion mode of the shovel 100 to either a normal mode for performing excavation operation and the like or a crane mode for performing a crane operation by using the hook 80. In this case, the normal mode is a motion mode of the shovel 100 in which the movement velocity of the attachment (for example, the boom 4) according to operator's operations with the operating device 26 is relatively fast, whereas the crane mode is a motion mode of the shovel 100 in which the movement velocity of the attachment according to operator's operations with the operating device 26 is relatively slow. Therefore, during the crane operation, for example, the motion of the boom 4 according to the operator's operations becomes relatively slow, and accordingly the shovel 100 can stably hoist and move a load. When the crane mode switch is turned on, the controller 30 switches the motion mode of the shovel 100 from the normal mode to the crane mode, and when the crane mode switch is turned off, the motion mode of the shovel 100 is switched from the crane mode to the normal mode.

In the crane mode, the controller 30 sets the target rotation speed of the engine 11 to a rotation speed lower than the rotation speed of the normal mode. Accordingly, in the crane mode, the controller 30 can more greatly slow the motion of the attachment than in the normal mode.

The sound output device 44 is provided in the cab 10, and is configured to output various kinds of sounds under the control of the controller 30. The sound output device 44 is, for example, a speaker, a buzzer, and the like.

The hook containing state detection device 51 detects the containing state of the hook 80 to the attachment (the hook container 50). For example, the hook containing state detection device 51 is a switch that becomes conductive in a case where the hook 80 is present in the hook container 50, and becomes nonconductive in a case where the hook 80 is not present in the hook container 50. The hook containing state detection device 51 is connected via a cable 35 to the controller 30, and the controller 30 can determine whether the hook 80 is contained in the hook container 50 according to whether the hook containing state detection device 51 is either in a conductive state or in a non-conductive state.

It should be noted that the controller 30 may automatically switch the motion mode of the shovel 100 to either the crane mode or the normal mode, on the basis of detection information of the hook containing state detection device 51. In this case, the crane mode switch may be omitted. For example, when the controller 30 detects that the hook containing state detection device 51 changes from the conductive state to the nonconductive state and accordingly determines that the hook 80 is taken out from the hook container 50, the controller 30 may switch the motion mode of the shovel 100 from the normal mode to the crane mode. When the controller 30 detects that the hook containing state detection device 51 changes from the nonconductive state to the conductive state and accordingly determines that the hook 80 is returned back to the hook container 50, the controller 30 may switch the motion mode of the shovel 100 from the crane mode to the normal mode.

The boom angle sensor S1 is attached to the boom 4 to detect the elevation angle of the boom 4 with respect to the upper turning body 3 (hereinafter referred to as a "boom angle"). For example, the boom angle sensor S1 detects the angle formed by a straight line connecting both ends of the boom 4 with respect to the turning plane of the upper turning body 3 in a side view. The boom angle sensor S1 may include, for example, a rotary encoder, an acceleration sensor, a six-axis sensor, an IMU (Inertial Measurement Unit), and the like. The arm angle sensor S2, the bucket angle sensor S3, and the body angle sensor S4 are similarly configured as described above. The detection signal corresponding to the boom angle θ1 detected by the boom angle sensor S1 is input to the controller 30.

The arm angle sensor S2 is attached to the arm 5 to detect a rotation angle of the arm 5 with respect to the boom 4 (hereinafter referred to as an "arm angle"). For example, the arm angle sensor S2 detects an angle formed by a straight line connecting both of the rotational axes points at both ends of the arm 5 with respect to a straight line connecting both of the rotational axes points at both ends of the boom 4 in a side view. The detection signal corresponding to the arm angle θ2 detected by the arm angle sensor S2 is input to the controller 30.

The bucket angle sensor S3 is attached to the bucket 6 to detect a rotation angle of the bucket 6 with respect to the arm 5 (hereinafter referred to as a "bucket angle"). For example, the bucket angle sensor S3 detects an angle formed by a straight line connecting both of the rotational axes points at both ends of the bucket 6 with respect to a straight line connecting both of the rotational axes points at both ends of the arm 5 in a side view. The detection signal corresponding to the bucket angle θ3 detected by the bucket angle sensor S3 is input to the controller 30.

The body angle sensor S4 outputs detection information about the attitude state of the upper turning body 3. For example, the body angle sensor S4 is attached to the upper turning body 3 to detect attitude angles about two axes in the longitudinal direction and the lateral direction of the upper turning body 3, i.e., inclination angles (which are hereinafter referred to as a "longitudinal inclination angle" and a "lateral inclination angle", respectively). The body angle sensor S4 detects an attitude angle in the vertical direction of the upper turning body 3, i.e., a turn angle about a turn axis 2X. The detection signals corresponding to the inclination angles (the longitudinal inclination angle and the lateral inclination angle) and the turn angle detected by the body angle sensor S4 are input to the controller 30.

The boom rod pressure sensor S7R and a boom bottom pressure sensor S7B are attached to the boom cylinder 7 to detect the pressure of the rod-side oil chamber of the boom cylinder 7 (hereinafter referred to as a "boom rod pressure") and the pressure of the bottom-side oil chamber of the boom cylinder 7 (hereinafter referred to as a "boom bottom pressure"), respectively. The detection signals corresponding to the boom rod pressure and the boom bottom pressure detected by the boom rod pressure sensor S7R and the boom bottom pressure sensor S7B, respectively, are input to the controller 30.

The arm rod pressure sensor S8R and the arm bottom pressure sensor S8B are attached to the arm cylinder 8 to detect the pressure of the rod-side oil chamber of the arm cylinder 8 (hereinafter referred to as an "arm rod pressure") and the pressure of the bottom-side oil chamber of the arm cylinder 8 (hereinafter referred to as an "arm bottom pressure"), respectively. The detection signals corresponding to the arm rod pressure and the arm bottom pressure detected by the arm rod pressure sensor S8R and the arm bottom pressure sensor S8B, respectively, are input to the controller 30.

The bucket rod pressure sensor S9R and the bucket bottom pressure sensor S9B are attached to the bucket cylinder 9 to detect the pressure of the rod-side oil chamber of the bucket cylinder 9 (hereinafter referred to as a "bucket rod pressure") and the pressure of the bottom-side oil chamber of the bucket cylinder 9 (hereinafter referred to as a "bucket bottom pressure"). The detection signals corresponding to the bucket rod pressure and the bucket bottom pressure detected by the bucket rod pressure sensor S9R and the bucket bottom pressure sensor S9B, respectively, are input to the controller 30.

The relief valve V8R discharges hydraulic oil in the rod-side oil chamber of the arm cylinder 8 to a hydraulic oil tank T according to control instructions from the controller 30, and relieves the pressure of the hydraulic oil in the rod-side oil chamber of the arm cylinder 8. Accordingly, the arm cylinder 8 moves to the rod side, i.e., the extension side, due to the weight of the arm 5 connected at the end of the rod, and as a result, the arm 5 moves (rotates) in the closing direction.

For example, as illustrated in FIG. 2, the relief valve V8R may be provided in a high-pressure hydraulic line between the rod-side oil chamber of the arm cylinder 8 and the control valve 17. For example, as illustrated in FIG. 3, the relief valve V8R may be arranged in a portion of the high-pressure hydraulic line, between the rod-side oil chamber of the arm cylinder 8 and the control valve 17A of the control valve 17 corresponding to the arm cylinder 8, that is in the inside of the control valve 17. In other words, regardless of whether the relief valve VOR is in the outside or in the inside of the control valve 17, the relief valve V8R may be provided in the high-pressure hydraulic line between the control valve 17A corresponding to the arm cylinder 8 and the rod-side oil chamber of the arm cylinder 8.

The relief valve V8R may be provided in the control valve 17A. In this case, the relief valve V8R may discharge hydraulic oil from a hydraulic path, which is in communication with a port of the control valve 17A connected to the rod-side oil chamber of the arm cylinder 8, to a center bypass hydraulic path (a hydraulic path that circulates hydraulic oil of the main pump 14 to the hydraulic oil tank T) in the control valve 17.

As illustrated in FIG. 4, the hydraulic oil holding circuit 90 may be provided in a high-pressure hydraulic line between the rod-side oil chamber of the arm cylinder 8 and the control valve 17. The hydraulic oil holding circuit 90 is configured so that, in a case where a motion of the arm 5 in the closing direction (hereinafter referred to as an "arm closing operation") is not performed with the operating device 26, the hydraulic oil holding circuit 90 holds (the hydraulic pressure of) the hydraulic oil in the rod-side oil chamber of the arm cylinder 8. Accordingly, for example, even in a case where a leakage of hydraulic oil and the like occur on a downstream side (the arm cylinder 8 is defined as an upstream side), the hydraulic oil holding circuit 90 can prevent the arm 5 from overturning in the closing direction.

In this case, the relief valve V8R may be arranged closer to the control valve 17A (i.e., on a downstream side, if the arm cylinder side is defined as an upstream side) than is the hydraulic oil holding circuit 90 in the high-pressure hydraulic line between the rod-side oil chamber of the arm cylinder 8 and the control valve 17A in the control valve 17. Specifically, as illustrated in FIG. 4, the relief valve V8R may be arranged outside of the control valve 17, and more specifically, may be arranged in the high-pressure hydraulic line between the hydraulic oil holding circuit 90 and the control valve 17. Similarly with the case of FIG. 3, the relief valve V8R may be arranged in a portion of the high-pressure hydraulic line, between the rod-side oil chamber of the arm cylinder 8 and the control valve 17A of the control valve 17 corresponding to the arm cylinder 8, that is in the inside of the control valve 17. Also, as described above, the relief valve V8R may be arranged in the inside of the control valve 17A.

As illustrated in FIG. 5, the hydraulic oil holding circuit 90 is interposed in the high-pressure hydraulic line connecting the control valve 17 and the rod-side oil chamber of the arm cylinder 8. The hydraulic oil holding circuit 90 mainly includes a holding valve 90*a* and a spool valve 90*b*.

The holding valve 90*a* allows a flow of hydraulic oil from the control valve 17 to the rod-side oil chamber of the arm cylinder 8. Specifically, in response to an operation with the operating device 26 for moving the arm 5 in the opening direction (hereinafter referred to as an "arm opening motion"), the holding valve 90*a* supplies hydraulic oil, which is supplied through a hydraulic path 901 from the control valve 17, to the rod-side oil chamber of the arm cylinder 8 through a hydraulic path 903. The holding valve 90*a* cuts off a flow of hydraulic oil from the rod-side oil chamber of the arm cylinder 8 (the hydraulic path 903) to the hydraulic path 901 connected to the control valve 17. The holding valve 90*a* is, for example, a poppet valve.

The holding valve 90*a* is connected to one end of the hydraulic path 902 branching from the hydraulic path 901, so that the holding valve 90*a* can discharge the hydraulic oil of the rod-side oil chamber of the arm cylinder 8 to the hydraulic path 901 (the control valve 17) at the downstream through the spool valve 90*b* arranged in the hydraulic path 902. Specifically, in a case where the spool valve 90*b* arranged in the hydraulic path 902 is in a non-communicating state (a spool position at the left end in FIG. 5), the holding valve 90*a* holds the hydraulic oil of the rod-side oil chamber of the arm cylinder 8 so that the hydraulic oil is not discharged to the downstream side of the hydraulic oil holding circuit 90 (the hydraulic path 901). In a case where the spool valve 90*b* is in a communicating state (a spool position at the center or right end in FIG. 5), the holding valve 90*a* can discharge the hydraulic oil of the rod-side oil chamber of the arm cylinder 8 to the downstream side of the hydraulic oil holding circuit 90 through the hydraulic path 902.

The spool valve 90*b* is provided in the hydraulic path 902 and can detour and discharge the hydraulic oil of the rod-side oil chamber of the arm cylinder 8, which is cut off by the holding valve 90*a*, to the downstream of the hydraulic oil holding circuit 90 (the hydraulic path 901). The spool valve 90*b* includes a first spool position (a spool position at the left end in FIG. 5) for shutting off the hydraulic path 902, a second spool position (a spool position at the center in FIG. 5) for reducing the opening through the hydraulic path 902, and a third spool position (a spool position at the right end in FIG. 5) for fully opening and allowing communication through the hydraulic path 902. In this case, at the second spool position, the spool valve 90*b* varies the degree of reduction of the flow according to the magnitude of the pilot pressure applied to the pilot port.

In a case where a pilot pressure is not applied to the pilot port of the spool valve 90*b*, the spool of the spool valve 90*b* is at the first spool position, and accordingly, the hydraulic oil of the rod-side oil chamber of the arm cylinder 8 is not discharged to the downstream of the hydraulic oil holding circuit 90 (the hydraulic path 901) through the hydraulic path 902. In a case where the pilot pressure is applied to the pilot port of the spool valve 90*b*, the spool of the spool valve 90*b* is at the second or third spool position according to the magnitude of the pilot pressure thereof. Specifically, the spool valve 90*b* is configured such that, according to an increase in the pilot pressure applied to the pilot port, the degree of reduction of the flow becomes smaller at the second spool position, and also, the spool moves from the second spool position closer toward the third spool position. Then, when the pilot pressure applied to the pilot port of the spool valve 90*b* increases to a certain level, the spool moves to the third spool position.

In the present example, the spool valve 90*b* is provided with a pilot circuit for receiving the pilot pressure. The pilot circuit includes the pilot pump 15, an arm closing remote control valve 26Aa, an electromagnetic switching valve 92, and a shuttle valve 94.

The arm closing remote control valve 26Aa is connected through a pilot line 25A to the pilot pump 15. The arm closing remote control valve 26Aa is included in the lever device, for moving the arm cylinder 8, of the operating device 26, and uses the hydraulic oil supplied from the pilot pump 15 to output, to a pilot line 270, the pilot pressure corresponding to the closing motion of the arm 5.

The electromagnetic switching valve 92 is provided in a pilot line 25B that is branched from the pilot line 25A between the pilot pump 15 and the arm closing remote control valve 26Aa and that is connected to one of the input ports of the shuttle valve 94 by bypassing the arm closing remote control valve 26Aa. The electromagnetic switching valve 92 switches the pilot line 25B to either a communicating state or a non-communicating state.

One of the input ports of the shuttle valve 94 is connected to one end of the pilot line 25B, and the other of the input ports of the shuttle valve 94 is connected to one end of the pilot line 270 at the secondary side of the arm closing remote control valve 25Aa. The shuttle valve 94 outputs one of the pilot pressures of the two input ports, whichever is higher, to the pilot port of the spool valve 90*b*. Accordingly, in a case where the arm closing operation is performed, the pilot pressure is applied from the shuttle valve 94 to the pilot port of the spool valve 90*b* to cause the spool valve 90*b* to be into the communicating state. Therefore, in response to the arm closing operation with the lever device 26A, the spool valve 90*b* can discharge the hydraulic oil of the rod-side oil chamber of the arm cylinder 8 to the downstream of the hydraulic oil holding circuit 90 (the hydraulic path 901) through the hydraulic path 902. Specifically, in a case where the arm closing operation is performed with the operating device 26 together with the arm closing operation with the operating device 26, the spool valve 90*b* discharges the hydraulic oil, which is cut off by the holding valve 90*a*, from the rod-side oil chamber of the arm cylinder 8. Even in a case where the arm closing operation is not performed with the operating device 26, the shuttle valve 94 can apply the pilot pressure to the pilot port of the spool valve 90*b* from the electromagnetic switching valve 92 through the shuttle valve 94 under the control of the controller 30. Therefore, the controller 30 can cancel the hydraulic oil holding function of the hydraulic oil holding circuit 90 (the spool valve 90*b*) via the electromagnetic switching valve 92, so that, regardless of whether the arm closing operation is performed with the operating device 26 (the lever device), the controller 30 can cause the hydraulic path 902 to be in the communicating state to discharge the hydraulic oil of the rod-side oil chamber of the arm cylinder 8 to the downstream of the hydraulic oil holding circuit 90 (the hydraulic path 901). Therefore, by cancelling the hydraulic oil holding function of the hydraulic oil holding circuit 90 via the electromagnetic switching valve 92, the controller 30 can activate the release function of the pressure at the downstream side of the hydraulic oil holding circuit 90, i.e., can activate the release function of the pressure in the rod-side oil chamber of the arm cylinder 8, by the relief valve V8R arranged on the side of the control valve 17. Then, while the release function of the pressure in the rod-side oil chamber of the arm cylinder 8 by the relief valve V8R is activated, the controller 30 outputs a control instruction to the relief valve V8R, so that the relief valve V8R can release the pressure in the rod-side oil chamber of the arm cylinder 8.

Note that the relief valve V8R may be arranged in the high-pressure hydraulic line on the side closer to the arm cylinder 8 than is the holding valve 90*a* of the hydraulic oil holding circuit 90. In this case, regardless of whether the hydraulic oil holding function of the hydraulic oil holding circuit 90 is cancelled, the relief valve V8R can discharge the hydraulic oil of the rod-side oil chamber of the arm cylinder 8 to the hydraulic oil tank T. In other words, the controller 30 outputs a control instruction to the relief valve V8R without cancelling the hydraulic oil holding function of the hydraulic oil holding circuit 90, so that the relief valve V8R can be caused to release the pressure in the rod-side oil chamber of the arm cylinder 8. Instead of the relief valve V8R, a control valve (a regenerative valve) for discharging (supplying) the hydraulic oil of the rod-side oil chamber of the arm cylinder 8 to the bottom-side oil chamber of the arm cylinder 8 may be employed. In this case, according to control instructions from the controller 30, the regenerative valve is opened, from the fully closed state, according to the degree of opening corresponding to the contents of the control instruction. Accordingly, due to the weight of the arm 5, the hydraulic oil of the rod-side oil chamber of the arm cylinder 8 is regenerated through the regenerative valve to the bottom-side oil chamber of the arm cylinder 8, so that the arm 5 is moved in the lowering direction.

The dynamic unstable state determination part 301 determines whether the body including the lower traveling body 1 and the upper turning body 3 of the shovel 100 is in a dynamic unstable state (hereinafter referred to as a "dynamic unstable state"). The dynamic unstable state of the body represents a state in which a predetermined unstable phenomenon may occur during aerial motion of the attachment due to a dynamic disturbance exerted on the body (for example, an reaction moment exerted by the motion of the attachment, a moment exerted while the lower traveling body 1 travels, and the like) according to motions of the shovel 100. Also, the dynamic unstable state of the body may include a state in which, during motions other than aerial motions of the attachment (for example, during an excavation motion of the attachment), a predetermined unstable phenomenon may occur due to a dynamic disturbance exerted on the body according to motions of the shovel 100.

Figure 6A:
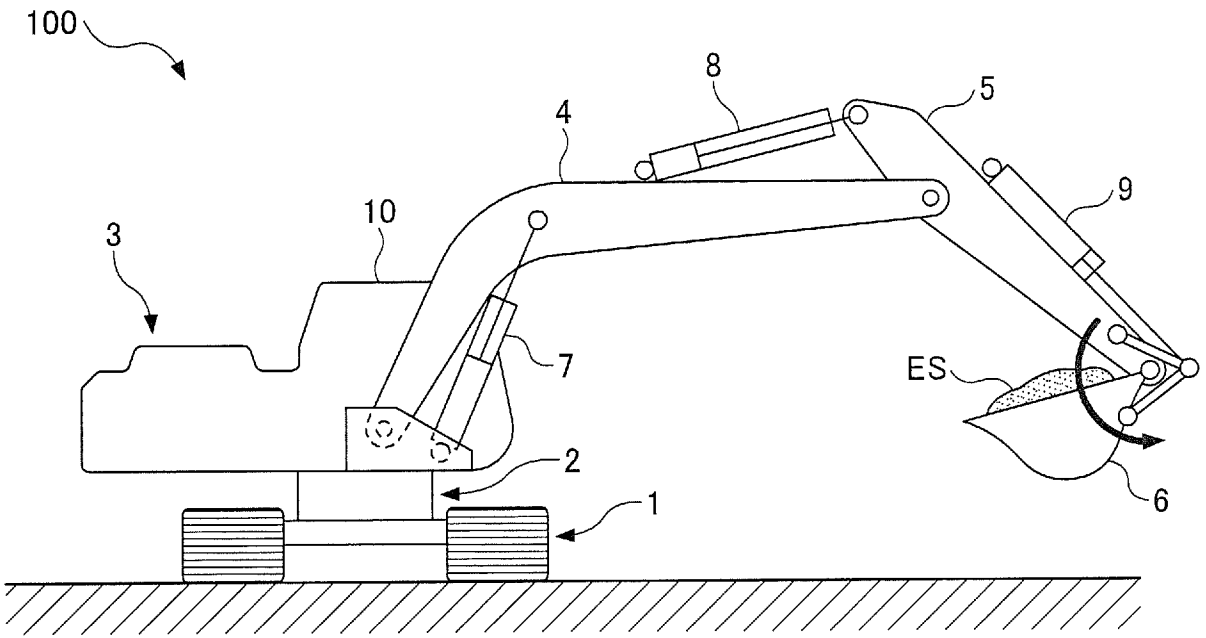
FIG. 6A is a drawing illustrating a specific example of a rear part lifting up phenomenon of the shovel.
Figure 6B:
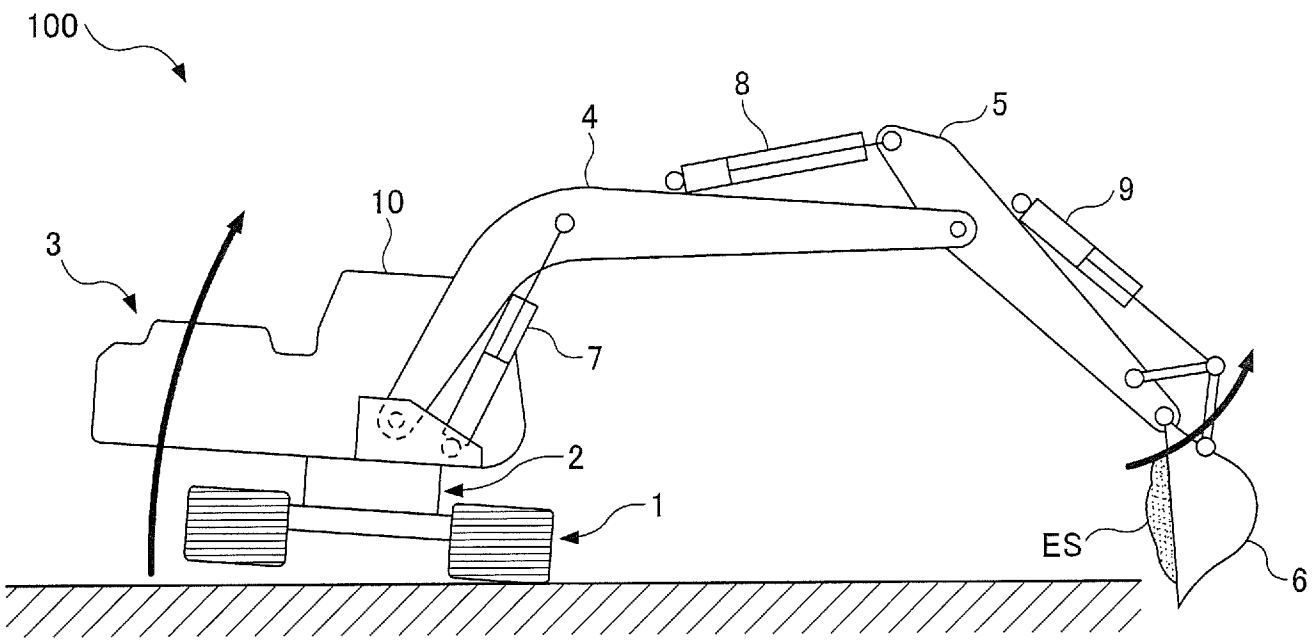
FIG. 6B is a drawing illustrating a specific example of a rear part lifting up phenomenon of the shovel.

For example, FIG. 6A and FIG. 6B are drawings illustrating, as examples of predetermined unstable phenomena, specific examples of unstable phenomena in which a rear part of the body of the shovel 100 (the lower traveling body 1) lifts up (hereinafter referred to as a "rear part lifting up phenomenon"). Specifically, FIG. 6A is a drawing illustrating a state in which the shovel 100 contains (carries) a pile of earth ES in the bucket 6. FIG. 6B is a drawing illustrating a state in which the shovel 100 performs an opening motion for opening the bucket 6 from the state of FIG. 6A to unload the earth ES contained in the bucket 6.

As illustrated in FIG. 6A, when the bucket 6 performs an opening motion in response to the operator's operations in the state in which the attachment is carrying the earth ES in the bucket 6 in the air, an reaction moment (hereinafter referred to as a "dynamic overturning moment"), which is a dynamic disturbance of the opening motion, is exerted on the upper turning body 3 by way of the attachment.

The dynamic overturning moment is exerted around a ground contact point of the front end portion of the lower traveling body 1 (in the present example, an outer edge of one of the pair of right and left crawlers) as a (hereinafter referred to as a "overturning fulcrum fulcrum") in such a manner as to cause the body of the shovel 100 to overturn forward, i.e., in such a manner as to lift the rear part of the lower traveling body 1. Also, the dynamic overturning moment increases according to an increase in the distance between the position of the bucket 6 and the overturning fulcrum, i.e., increases according to an increase in the distance between the position of the bucket 6 and the body (the lower traveling body 1 and the upper turning body 3). Also, the dynamic moment increases according to an increase in the weight including the object on the bucket 6. Also, the dynamic overturning moment increases according to an increase in an opening speed of the bucket 6 (i.e., according to an increase in the acceleration). As illustrated in FIG. 6A, in a case where the direction of the upper turning body 3 with respect to the lower traveling body 1, i.e., the extension direction of the attachment, is different from the traveling direction of the lower traveling body 1, the front end of the ground contact point of the lower traveling body 1 (overturning fulcrum) comes close to the center of the body, and accordingly, the position of the bucket 6 moves relatively distant from the overturning fulcrum, which increases the dynamic overturning moment.

Therefore, depending on conditions such as the relationship in position of the bucket 6 with respect to the body, the weight including the object on the bucket 6, the velocity and the acceleration of the opening motion of the bucket 6, and the direction of the upper turning body 3 with respect to the lower traveling body 1, the overturning moment relatively increases, and as illustrated in FIG. 6B, a rear part lifting up phenomenon of the shovel 100 may occur.

For example, the shovel 100 may unload a pile of earth and the like in the bucket 6 to the outside by opening the arm 5 while lowering the boom 4. Similarly, in this case, the dynamic overturning moment caused by such a motion of the attachment is exerted on the body, and the rear part lifting up phenomenon of the shovel 100 may occur.

Also, for example, while the shovel 100 (the lower traveling body 1) is traveling with its attachment being oriented in the traveling direction, the traveling of the shovel 100 may be hindered due to the operator's operations, the impact of unevenness of the ground, and the like, and as a result, the lower traveling body 1 may rapidly decelerate. In this case, the dynamic overturning moment around the overturning fulcrum, based on the inertial force exerted on the body and the attachment caused by the rapid deceleration of the shovel 100, may be exerted on the body, and the rear part lifting up phenomenon of the shovel 100 may occur.

It should be noted that the state "with its attachment being oriented in the traveling direction" includes not only a state in which the traveling direction of the lower traveling body 1 exactly matches the direction of the attachment but also a state in which a difference between the traveling direction of the lower traveling body 1 and the direction of the attachment is relatively small. This is also applicable to the examples explained below.

For example, when the shovel 100 enters a downslope with a relatively large gradient or the front part of the lower traveling body 1 falls in a relatively large pothole while the shovel 100 (the lower traveling body 1) is traveling with its attachment being oriented in the traveling direction, the amount of forward tilt of the body may rapidly increase. In this case, because the amount of forward tilt of the body rapidly increases, a downward acceleration (a gravity acceleration) occurs in the body, and immediately after the front part of the lower traveling body 1 comes into contact with the ground, a rapid deceleration occurs in the body (the lower traveling body 1). As a result, according to this rapid deceleration, the dynamic overturning moment about the overturning fulcrum based on the inertial force exerted on the attachment may be exerted, and the rear part lifting up phenomenon of the shovel 100 may occur.

Hereinafter, a situation where a predetermined unstable phenomenon occurs due to a dynamic disturbance exerted on the body (a dynamic overturning moment) according to motions of the shovel 100 as described above is referred to as a "dynamic unstable situation".

For example, the dynamic unstable state determination part 301 may determine whether the body of the shovel 100 is in a dynamic unstable state by comparing an overturning moment for causing the body of the shovel 100 to overturn forward about the overturning fulcrum (the ground contact point of the front end portion of the lower traveling body 1) and a restraining moment for restraining the body of the shovel 100 from overturning forward.

The overturning moment includes a static overturning moment (hereinafter referred to as a "static overturning moment") due to the weight of the attachment and the dynamic overturning moment explained above due to motions of the shovel 100. Among them, the dynamic overturning moment depends on: the load state of the attachment, i.e., thrusts F1 to F3 of the boom cylinder 7, the arm cylinder 8, and the bucket cylinder 9, respectively; and the attitude state and the motion state of the attachment, i.e., the attitude angle, the angular speed, and the angular acceleration, about the fulcrum, of the boom 4, the arm 5, and the bucket 6, respectively. The restraining moment depends on: the weight of the body of the shovel 100, i.e., the weight of the lower traveling body 1 and the upper turning body 3; the distance between the overturning fulcrum and each of the centers of gravity; and the like.

Therefore, the dynamic unstable state determination part 301 can calculate the overturning moment on the basis of detection information about the load state, the attitude state, and the motion state, i.e., the detection values detected by sensors S1 to S3, S7B, S7R, S8B, S8R, S9B, S9R, and the like. Also, the dynamic unstable state determination part 301 can calculate the restraining moment on the basis of the weights of the lower traveling body 1 and the upper turning body 3 of the shovel 100, the distance between the overturning fulcrum and each of the centers of gravities, and the like. Then, the dynamic unstable state determination part 301 may determine whether the calculated values of the overturning moment and the restraining moment satisfy a predetermined conditional expression in such a range that the overturning moment does not exceed the restraining moment (hereinafter referred to as a "dynamic overturning inhibition conditional expression"). Accordingly, the dynamic unstable state determination part 301 can determine that the body of the shovel 100 is in the dynamic unstable state in a case where the dynamic overturning restraining conditional expression is not satisfied.

Also, for example, the dynamic unstable state determination part 301 may determine whether the body of the shovel 100 is in the dynamic unstable state by ascertaining a specific situation (a dynamic unstable situation) in which a dynamic unstable phenomenon is likely to occur according to motions of the shovel 100.

Specifically, the dynamic unstable state determination part 301 may determine that the body of the shovel 100 is in the dynamic unstable state in a case where the attachment performs an unloading motion for unloading the object in the bucket 6 (for example, an: 30 earth-unloading motion for unloading the earth ES as illustrated in FIG. 6A and FIG. 6B). In this case, the controller 30 may determine whether the attachment performs the unloading motion for unloading the object in the bucket 6 on the basis of the current attitude state of the attachment that is ascertained from the detection values detected by the boom angle sensor S1, the arm angle sensor S2, and the bucket angle sensor S3, and the motion state of the shovel 100 immediately before the current motion state (for example, whether a turn motion is performed in such an attitude state of the attachment that the earth and the like are loaded in the bucket 6).

Also, the dynamic unstable state determination part 301 may determine that the body of the shovel 100 is in the dynamic unstable state in a case where the lower traveling body 1 rapidly decelerates while the shovel 100 (the lower traveling body 1) is traveling with its attachment being oriented in the traveling direction. In this case, the controller 30 may determine the degree of match between the direction of the attachment and the traveling direction of the lower traveling body 1 on the basis of the turn angle of the upper turning body 3 detected by the body angle sensor S4. Also, the controller 30 may determine the deceleration state of the lower traveling body 1 on the basis of the detection values detected by (the acceleration sensors and the like included in) the body angle sensor S4.

Also, the dynamic unstable state determination part 301 may determine that the body of the shovel 100 is in the dynamic unstable state in a case where the amount of inclination of the body rapidly increases while the shovel 100 (the lower traveling body 1) is traveling with its attachment being oriented in the traveling direction. In this case, the controller 30 may determine the increased state of the amount of inclination of the body on the basis of the detection information of the body angle sensor S4.

The static unstable state determination part 302 determines whether the body of the shovel 100 is in a static unstable state (hereinafter referred to as a "static unstable state"). The static unstable state of the body represents a state in which, when the shovel 100 is assumed to be under a static or semi-static circumstance where a dynamic disturbance is not exerted to the body during aerial motion of the attachment, a predetermined unstable phenomenon may occur in the body. In this case, the static circumstance of the shovel 100 means a circumstance in which the shovel 100 is stationary. The semi-static circumstance of the shovel 100 means a mild motion circumstance of the shovel 100 to such a degree that a dynamic disturbance to the body can be disregarded, and is, for example, a motion circumstance of the shovel 100 (the attachment) in the crane operation.

Figure 7:
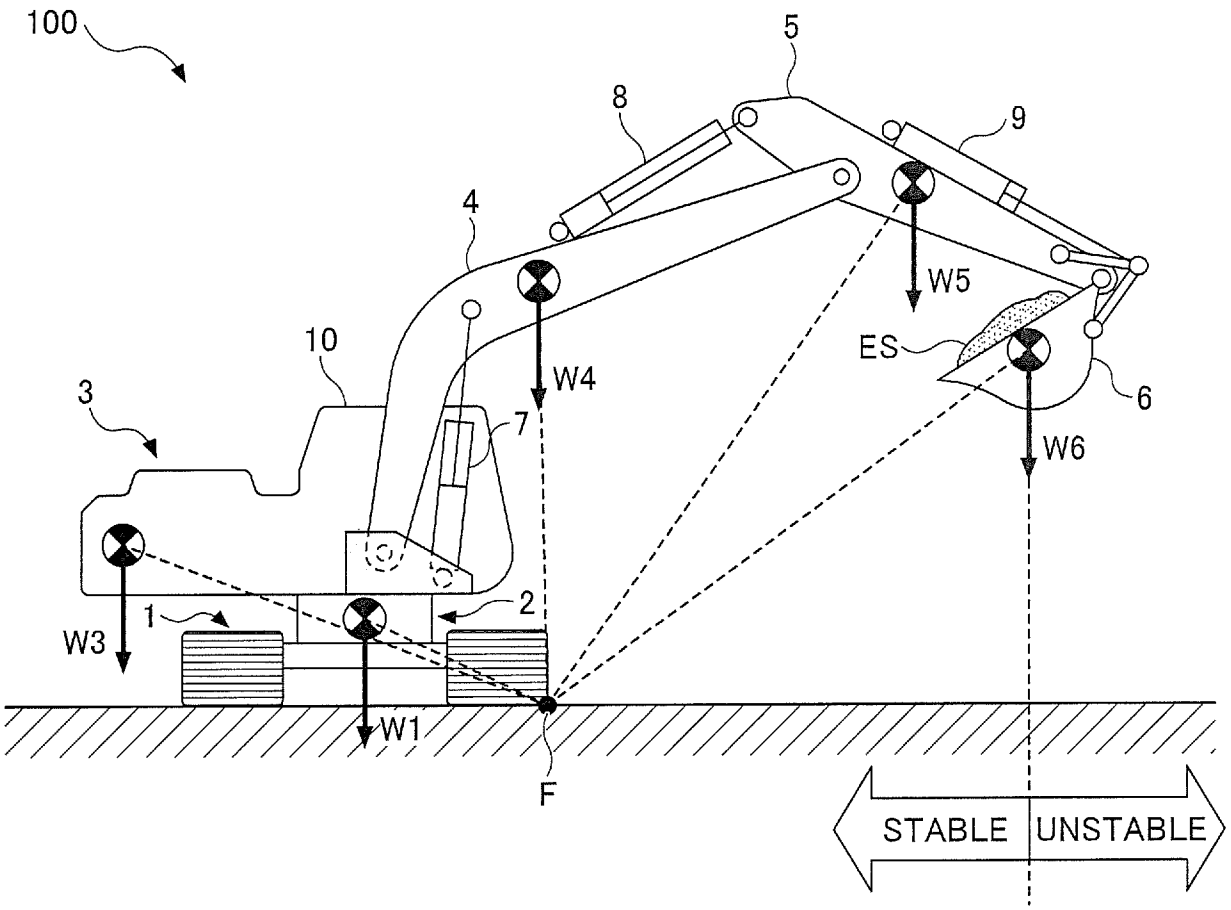
FIG. 7 is a drawing for explaining static overturning moment exerted on the body of the shovel.

For example, FIG. 7 is a drawing for explaining, as an example of the predetermined unstable phenomenon, a static overturning moment for causing the rear part lifting up phenomenon and a restraining moment for reducing the rear part lifting up phenomenon in the body of the shovel 100 under the static or semi-static circumstance of the attachment.

As illustrated in FIG. 7, a weight W4 of the boom 4 exerted at the position of the center of gravity thereof, a weight W5 of the arm 5 exerted at the position of the center of gravity thereof, and a weight W6 of the bucket 6 exerted at the position of the center of gravity thereof exert, to the body, a static overturning moment for causing the body of the shovel 100 to overturn forward, i.e., causing the rear part of the body to lift up, around an overturning fulcrum F, i.e., a front end ground contact point of the lower traveling body 1.

Conversely, a weight W1 of the lower traveling body 1 including the turn mechanism 2 exerted at the position of the center of gravity thereof and a weight W3 of the upper turning body 3 exerted at the position of the center of gravity thereof exert, to the body, a restraining moment for reducing the body of the shovel 100 from overturning forward, i.e., restraining the rear part of the body from lifting up around the overturning fulcrum F.

Therefore, in a case where the end of the attachment, i.e., the position of the bucket 6, moves relatively distant from the body (the overturning fulcrum F) under the static or semi-static circumstance of the shovel 100 during aerial motion of the attachment, the static overturning moment changes to an increasing direction. In particular, when the boom 4 performs lowering motion while the position of the bucket 6 is relatively distant from the body, the position of the bucket 6 moves farther away from the overturning fulcrum F according to a descent of the boom 4 rotating about the connection point with the upper turning body 3 as the fulcrum. Therefore, the static overturning moment increases excessively, and accordingly, the rear part of the body may lift up, and the body may overturn forward.

As compared with the case where the object such as the earth ES is not contained in the bucket 6, the overturning moment changes in an increasing direction when the object such as the earth ES is contained in the bucket 6 as illustrated in FIG. 7. Therefore, for example, when a motion for loading and raising a target object such as a pile of earth on the bucket 6 is performed, the static overturning moment increases excessively, depending on the attitude state of the attachment, and accordingly, the rear part of the body may lift up, and the body may overturn forward.

Also, as illustrated in FIG. 7, when the difference between the direction of the upper turning body 3, i.e., the direction of the attachment (the extension direction), and the traveling direction of the lower traveling body 1 relatively increases, the overturning fulcrum F of the lower traveling body 1 comes closer to the position of the center of gravity of the body (the lower traveling body 1 and the upper turning body 3), but moves away from the position of the center of gravity of the attachment (the boom 4, the arm 5, and the bucket 6). As a result, the overturning moment (the static overturning moment) changes in an increasing direction, but the restraining moment changes in a decreasing direction. Therefore, when the difference between the direction of the upper turning body 3, i.e., the direction of the attachment, and the traveling direction of the lower traveling body 1 relatively increases, the static overturning moment may increase excessively with respect to the restraining moment, depending on the attitude state of the attachment, and accordingly, the rear part of the body may lift up, and the body may overturn forward.

Also, for example, when the shovel 100 enters a downslope while the shovel 100 (the lower traveling body 1) is traveling with its attachment being oriented in the traveling direction, the static overturning moment relatively increases, i.e., changes in an increasing direction, but the restraining moment relatively decreases, i.e., changes in a decreasing direction. Therefore, when the shovel 100 enters a downslope while the shovel 100 (the lower traveling body 1) is traveling with its attachment being oriented in the traveling direction, and accordingly, the amount of forward tilt of the body increases, the static overturning moment may increase excessively with respect to the restraining moment, and accordingly, the rear part of the body may lift up, and the body may overturn forward.

Hereinafter, a situation where a predetermined unstable phenomenon may occur due to a change in the static moment (the static overturning moment and the restraining moment) according to motions of the shovel 100 as described above is referred to as a "static unstable situation".

For example, the static unstable state determination part 302 may determine whether the body of the shovel 100 is in the static unstable state by comparing the static overturning moment and the restraining moment around the overturning fulcrum. Specifically, the static unstable state determination part 302 can calculate the static overturning moment on the basis of the detection values detected by the sensors S1 to S4. Also, the static unstable state determination part 302 can calculate the restraining moment from the weight of the lower traveling body 1 and the upper turning body 3 of the shovel 100, the distance between the overturning fulcrum and each of the centers of gravities, and the like. Then, the static unstable state determination part 302 may determine whether the calculated values of the static overturning moment and the restraining moment satisfy a predetermined conditional expression so that the static overturning moment does not exceed the restraining moment (hereinafter referred to as a "static overturning restraining conditional expression"). Accordingly, the static unstable state determination part 302 can determine that the body of the shovel 100 is in the static unstable state in a case where the static overturning restraining conditional expression is not satisfied.

Also, for example, the static unstable state determination part 302 may determine whether the body of the shovel 100 is in the static unstable state, on the basis of the position of the bucket 6 with reference to the lower traveling body 1, the weight including the object on the bucket 6, the direction of the upper turning body 3 with reference to the lower traveling body 1 (the extension direction of the attachment), the inclination state of the work surface of the shovel 100, and the like. This is because, as described above, the occurrence of the unstable phenomenon in the body of the shovel 100 is affected by the position of the bucket 6 with reference to the lower traveling body 1, the weight including the object on the bucket 6, the direction of the upper turning body 3 with reference to the lower traveling body 1 (the extension direction of the attachment), the inclination state of the work surface of the shovel 100, and the like. In this case, the static unstable state determination part 302 can calculate the position of the bucket 6 with reference to the lower traveling body 1 on the basis of: the detection values detected by the boom angle sensor S1, the arm angle sensor S2, and the bucket angle sensor S3; known link lengths of the boom 4, the arm 5, and the bucket 6; and the like. Also, the static unstable state determination part 302 can calculate the weight of the bucket 6 on the basis of the detection values detected by the boom angle sensor S1, the arm angle sensor S2, and the bucket angle sensor S3; the boom bottom pressure detected by the boom bottom pressure sensor S7B; and the like. Also, the static unstable state determination part 302 can calculate the direction of the upper turning body 3 with respect to the lower traveling body 1 (for example, a turn angle) on the basis of the detection value detected by the body angle sensor S4. Also, the static unstable state determination part 302 can calculate the inclination state of the work surface with reference to the lower traveling body 1 (whether there is an inclination, and an inclination direction) and the like, on the basis of the detection value detected by the body angle sensor S4. Specifically, the static unstable state determination part 302 may calculate the degree of stability indicating how unlikely predetermined unstable phenomena such as the rear part lifting up phenomenon occurs under the static or semi-static circumstance of the attachment (hereinafter referred to as a "the degree of static stability"), and in a case where the degree of static stability becomes less than a predetermined reference, the static unstable state determination part 302 may determine that the body of the shovel 100 is in the static unstable state.

Also, for example, the static unstable state determination part 302 may determine whether the body of the shovel 100 is in the static unstable state by ascertaining a specific situation (a static unstable situation) in which a static unstable phenomenon (the rear part lifting up phenomenon) is likely to occur in the body of the shovel 100.

Specifically, the static unstable state determination part 302 may determine that the body of the shovel 100 is in the static unstable state in a case where the position of the bucket 6 is relatively distant from the body (specifically, in a case where the distance between the overturning fulcrum and the bucket 6 is more than a predetermined threshold value) during aerial motion of the attachment. Also, the static unstable state determination part 302 may determine that the body of the shovel 100 is in the static unstable state in a case where the lowering motion of the boom 4 is performed while the bucket 6 is relatively distant from the body (the overturning fulcrum) during aerial motion of the attachment. In this case, the controller 30 can determine the relative position of the bucket 6 with respect to the body and the motion state of the boom 4 on the basis of the detection values detected by the boom angle sensor S1, the arm angle sensor S2, and the bucket angle sensor S3.

Also, the static unstable state determination part 302 may determine that the body of the shovel 100 is in the static unstable state in a case where the attachment is performing a motion to load and raise the target object such as a pile of earth. Also, the static unstable state determination part 302 may determine that the body of the shovel 100 is in the static unstable state in a case where the attachment is performing a motion to load and raise the target object such as a pile of earth while the bucket 6 is relatively distant from the body (the overturning fulcrum). In this case, the controller 30 can determine the state of the motion of the attachment on the basis of: the detection values detected by the boom angle sensor S1, the arm angle sensor S2, and the bucket angle sensor S3; and the motion state of the operating device 26 with regard to the attachment.

Also, the static unstable state determination part 302 may determine that the body of the shovel 100 is in the static unstable state in a case where the upper turning body 3 is turning so that the direction of the attachment moves away from the traveling direction of the lower traveling body 1. Also, the static unstable state determination part 302 may determine that the body of the shovel 100 is in the static unstable state in a case where the upper turning body 3 is turning so that the direction of the attachment moves away from the traveling direction of the lower traveling body 1 while the bucket 6 is relatively distant from the body (the overturning fulcrum). In this case, the controller 30 can determine the turn state of the upper turning body 3 with respect to the traveling direction of the lower traveling body 1 on the basis of the detection value detected by the body angle sensor S4 and the motion state of the operating device 26 with regard to the upper turning body 3.

Also, the static unstable state determination part 302 may determine that the body of the shovel 100 is in the static unstable state in a case where the amount of forward tilt of the body of the shovel 100 increases (relatively mildly) while the shovel 100 (the lower traveling body 1) is traveling with its attachment being oriented in the traveling direction. Also, the static unstable state determination part 302 may determine that the body of the shovel 100 is in the static unstable state in a case where the amount of forward tilt of the body of the shovel 100 increases (relatively mildly) while the shovel 100 (the lower traveling body 1) is traveling with its attachment being oriented in the traveling direction while the bucket 6 is relatively distant from the body (the overturning fulcrum). In this case, the controller 30 can determine the direction of the attachment with respect to the traveling direction of the lower traveling body 1 and the forward inclination state of the body on the basis of the detection value detected by the body angle sensor S4.

The stabilization control part 303 performs a control (hereinafter referred to as a "stabilization control") for reducing an occurrence of an unstable phenomenon that occurs in the body of the shovel 100 (for example, the rear part lifting up phenomenon explained above) and stabilizing the body of the shovel 100. The stabilization control is explained later in detail.

<Detail of Stabilization Control>

Subsequently, the stabilization control by the controller 30 is explained in detail with reference to not only FIGS. 6A, 6B and FIG. 7 but also FIG. 8 and FIGS. 9A, 9B.

First Example of Stabilization Control

In a case where the dynamic unstable state determination part 301 determines that the body of the shovel 100 is in the dynamic unstable state, the stabilization control part 303 outputs a control instruction to the relief valve V8R, or to the relief valve V8R and the electromagnetic switching valve 92, so that the pressure in the rod-side oil chamber of the arm cylinder 8 is released.

As a result, for example, as in the case of FIG. 6A, in a case where the attachment performs an unloading motion for unloading the object such as the earth ES by performing the opening motion for opening the bucket 6, the stabilization control part 303 can release pressure in the rod-side oil chamber of the arm cylinder 8. Accordingly, while a dynamic disturbance due to the opening motion of the bucket 6 is transmitted from the arm 5 via the boom 4 to the body, the arm cylinder 8 can move in the extension direction, i.e., the closing direction of the arm 5, due to the weight of the arm 5. Therefore, with the movement of the arm cylinder 8 in the extension direction, at least a portion of the dynamic disturbance caused by the opening motion of the bucket 6 is less likely to be transmitted as the dynamic overturning moment exerted on the body, and accordingly, this can reduce the dynamic rear part lifting up phenomenon of the shovel 100.

For example, in a case where the attachment performs an unloading motion for unloading the object such as a pile of earth on the bucket 6 by performing a lowering motion for lowering the boom 4 and an opening motion for opening the arm 5, the stabilization control part 303 can release the pressure in the rod-side oil chamber of the arm cylinder 8. Accordingly, in a similar manner, the dynamic disturbance caused by the lowering motion for lowering the boom 4 and the opening motion for opening the arm 5 is less likely to be transmitted as the dynamic overturning moment exerted on the body, and accordingly, this can reduce the dynamic rear part lifting up phenomenon of the shovel 100.

For example, in a case where the shovel 100 (the lower traveling body 1) rapidly decelerates while the shovel 100 (the lower traveling body 1) is traveling with its attachment being oriented in the traveling direction, the stabilization control part 303 can release the pressure in the rod-side oil chamber of the arm cylinder 8. Therefore, at least a portion of the dynamic overturning moment around the overturning fulcrum caused by the rapid deceleration of the lower traveling body 1 can be absorbed by the movement of the arm cylinder 8 in the extension direction, so that the dynamic rear part lifting up phenomenon of the shovel 100 can be reduced.

For example, in a case where the amount of inclination of the body rapidly increases while the shovel 100 (the lower traveling body 1) is traveling with its attachment being oriented in the traveling direction, the stabilization control part 303 can release the pressure in the rod-side oil chamber of the arm cylinder 8. Therefore, at least a portion of the dynamic overturning moment about the overturning fulcrum based on the inertial force exerted on the attachment, which is caused when the lower traveling body 1 enters a steep slope or drops in a large pothole to cause the attachment to rapidly accelerate downward and thereafter rapidly decelerate, is absorbed by the movement of the arm cylinder 8 in the extension direction, so that the dynamic rear part lifting up phenomenon of the shovel 100 can be reduced.

In other words, when the dynamic unstable state determination part 301 determines that the body of the shovel 100 is in the dynamic unstable state, the stabilization control part 303 automatically or semi-automatically operates the arm 5 in the closing direction regardless of the state of the operator's operations (regardless of whether operations are performed). Specifically, the stabilization control part 303 operates the arm 5 in the closing direction so as to reduce the dynamic moment (the dynamic overturning moment) exerted on the body of the shovel 100 according to motions of the shovel 100. Accordingly, the stabilization control part 303 can reduce the occurrence of the unstable phenomenon of the body (the rear part lifting up phenomenon) due to the dynamic overturning moment exerted on the body according to motions of the shovel 100.

Also, when the stabilization control part 303 operates the arm 5 in the closing direction, the bucket 6 can be brought closer to the body side, i.e., the overturning fulcrum side, which is a more statically stable direction, as illustrated in FIG. 7. The stabilization control part 303 can also reduce the static overturning moment, and can improve the static stability of the body of the shovel 100.

It should be noted that, instead of releasing the pressure in the rod-side oil chamber of the arm cylinder 8, the stabilization control part 303 may supply hydraulic oil from the control valve 17 to the bottom-side oil chamber of the arm cylinder 8, regardless of the state of the operator's operations (regardless of whether operations are performed). In other words, in a case where dynamic unstable state determination part 301 determines that the body of the shovel 100 is in the dynamic unstable state, the stabilization control part 303 may operate the arm 5 in the closing direction by actively moving the arm cylinder 8 in the extension direction, regardless of the state of the operator's operations (regardless of whether operations are performed). This is also applicable to the second example of the stabilization control explained later.

Second Example of Stabilization Control

In a case where the static unstable state determination part 302 determines that the body of the shovel 100 is in the static unstable state, the stabilization control part 303 outputs a control instruction to the relief valve V8R, or to the relief valve V8R and the electromagnetic switching valve 92, so that the pressure in the rod-side oil chamber of the arm cylinder 8 is released.

Accordingly, the stabilization control part 303 can move the arm cylinder 8 in the extension direction to operate the arm 5 in the closing direction due to the weight of the arm 5. Therefore, as illustrated in FIG. 7, the stabilization control part 303 can bring the bucket 6 closer to the body side, which is a more statically stable direction.

Specifically, in a case where the static unstable state determination part 302 determines that the body of the shovel 100 is in the static unstable state, the stabilization control part 303 automatically or semi-automatically operates the arm 5 in the closing direction regardless of the operator's operations. Therefore, the stabilization control part 303 can reduce the occurrence of the unstable phenomenon of the body (the rear part lifting up phenomenon) under the static or semi-static circumstance of the shovel 100.

Specifically, the stabilization control part 303 can operate the arm 5 in the closing direction so as to reduce the change in the static moment (the static overturning moment and the restraining moment) exerted on the body including the lower traveling body 1 and the upper turning body 3 according to motions of the shovel 100.

For example, the stabilization control part 303 can operate the arm 5 in the closing direction in a case where the position of the bucket 6 relatively moves away from the body (i.e., the distance between the overturning fulcrum and the bucket 6 is more than a predetermined threshold value) during aerial motion of the attachment. Also, the stabilization control part 303 can operate the arm 5 in the closing direction in a case where the lowering motion of the boom 4 is performed while the bucket 6 is relatively distant from the body (the overturning fulcrum) during aerial motion of the attachment. Therefore, the stabilization control part 303 can reduce the increase in static overturning moment caused by the position of the bucket 6 moving away from the body, and can reduce a predetermined unstable phenomenon that could occur in the body.

For example, the stabilization control part 303 can operate the arm 5 in the closing direction in a case where the attachment is performing a motion for loading and raising the target object such as a pile of earth. For example, the stabilization control part 303 can operate the arm 5 in the closing direction in a case where the attachment is performing a motion for loading and raising the target object such as a pile of earth while the bucket 6 is relatively distant from the body (the overturning fulcrum). Therefore, the stabilization control part 303 can reduce a predetermined unstable phenomenon that could occur in the body by reducing the increase in the static overturning moment caused by the increase in the weight of the end portion of the attachment due to a pile of earth and the like loaded in the bucket 6.

For example, in a case where the amount of forward tilt of the body (relatively mildly) increases while the shovel 100 (the lower traveling body 1) is traveling with its attachment being oriented in the traveling direction, the stabilization control part 303 can operate the arm 5 in the closing direction. Also, in a case where the amount of forward tilt of the body (relatively mildly) increases while the shovel 100 (the lower traveling body 1) is traveling with its attachment being oriented in the traveling direction while the bucket 6 is relatively distant from the body (the overturning fulcrum), the stabilization control part 303 can operate the arm 5 in the closing direction. Therefore, the stabilization control part 303 can reduce a predetermined unstable phenomenon that could occur in the body by reducing the increase in the static overturning moment caused by the change in the inclination state of the work surface in the forward inclination direction while the lower traveling body 1 is traveling.

For example, in a case where the body of the shovel 100 is determined to be in the static unstable state while the shovel 100 is performing a semi-static motion, for example, a crane operation and the like, the stabilization control part 303 moves the arm 5 in the closing direction regardless of the operator's operations. Therefore, even when the body of the shovel 100 goes into a static unstable state because the operator concentrates on an operation (for example, the lowering motion for lowering the boom 4 and the like) that is other than the motions of the arm 5 corresponding to the crane operation, the occurrence of the unstable phenomenon in the body can be reduced regardless of the operator's operations.

Figure 8:
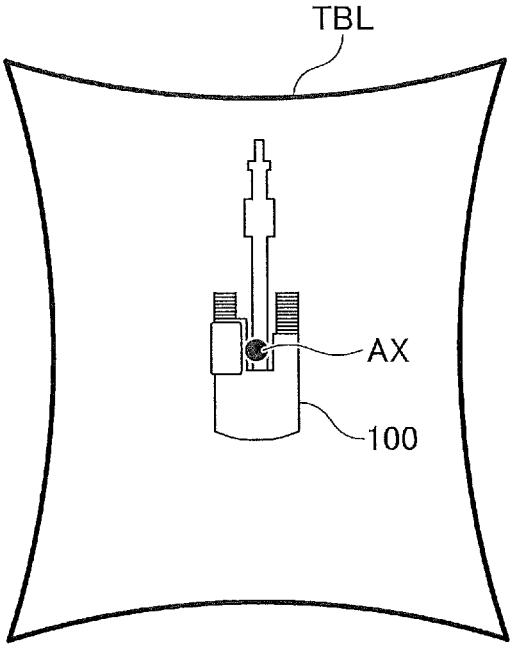
FIG. 8 is a plan view illustrating a specific example of a stable range of the shovel in view of the direction of the upper turning body with respect to the lower traveling body.

For example, FIG. 8 is a plan view illustrating a specific example of a stable range of the attachment in view of the direction of the upper turning body 3 with respect to the lower traveling body 1 (i.e., the direction of the attachment). FIG. 8 illustrates an outer edge of a stable range, i.e., illustrates a border (hereinafter referred to as a "stable range border") TBL between a stable range and an unstable range located outside of the stable range with respect to the lower traveling body 1. Hereinafter, this is also applicable to FIG. 9A and FIG. 9B explained later.

The stable range of the attachment is defined as the work range of the attachment with reference to the lower traveling body 1 (i.e., the range of the position of the bucket 6 which is the end of the attachment) when the body is in the statically stable state in which a predetermined unstable phenomenon such as the rear part lifting up phenomenon and the like of the body is less likely to occur under the static or semi-static circumstance of the shovel 100. For example, the stable range is a range in which the degree of static stability explained above is equal to or more than a predetermined reference, and the stable range border TBL corresponds to the predetermined reference.

As illustrated in FIG. 8, in a case where the traveling direction of the lower traveling body 1 and the direction of the upper turning body 3 (the direction of the attachment) are the same as each other, the stable range border TBL is set at a position relatively distant from the center of the body. Conversely, in a case where the traveling direction of the lower traveling body 1 and the direction of the upper turning body 3 are not the same as each other and the difference therebetween is relatively large, the stable range border TBL comes closer to the center of the body (a turn center AX). In a case where the difference between the direction of the upper turning body 3 and the traveling direction of the lower traveling body 1 is 90 degrees, the stable range border TBL comes closest to the center of the body. This is because when there is a difference between the traveling direction of the lower traveling body 1 and the direction of the upper turning body 3, the front end portion of the lower traveling body 1 with reference to the direction of the upper turning body 3 (the attachment), i.e., the overturning fulcrum, comes relatively closer to the center of the body (the turn center AX). Specifically, the stable range of the attachment is relatively set larger when the direction of the upper turning body 3 is in the traveling direction of the lower traveling body 1 (the longitudinal direction of FIG. 8) as seen from the turn center AX of the shovel 100. However, the stable range of the attachment becomes relatively narrower when the direction of the upper turning body 3 as seen from the turn center AX of the shovel 100 is relatively distant from the traveling direction of the lower traveling body 1, and the stable range of the attachment becomes the narrowest when the direction of the upper turning body 3 as seen from the turn center AX of the shovel 100 is in the lateral direction of the lower traveling body 1.

Figure 9A:
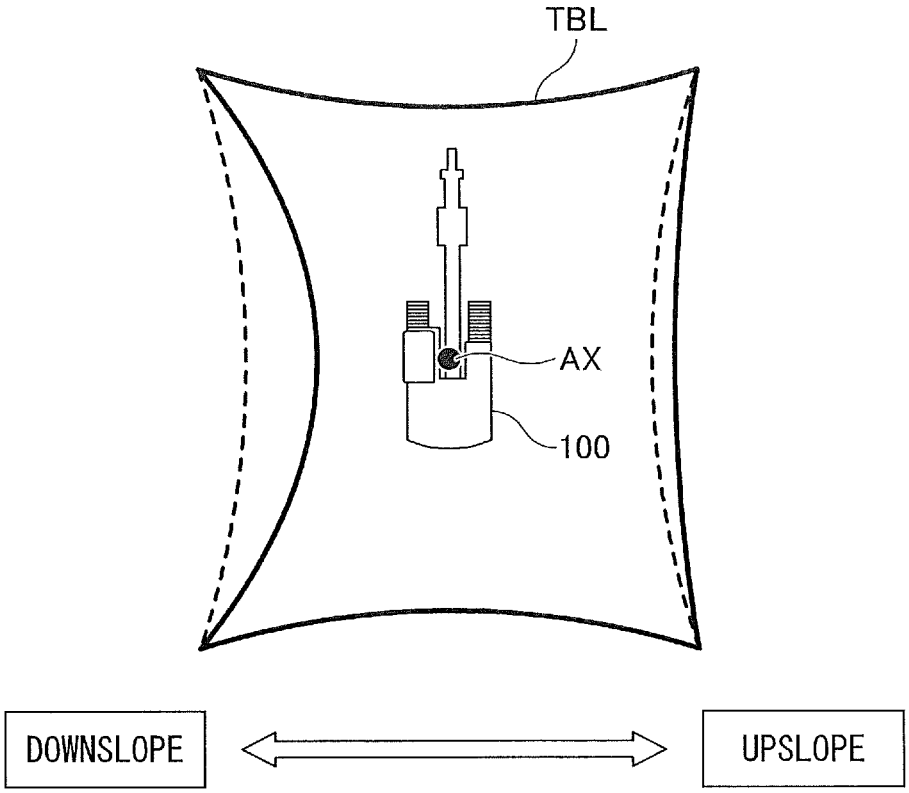
FIG. 9A is a plan view illustrating a specific example of a stable range of the attachment in view of the inclination of the work surface.
Figure 9B:
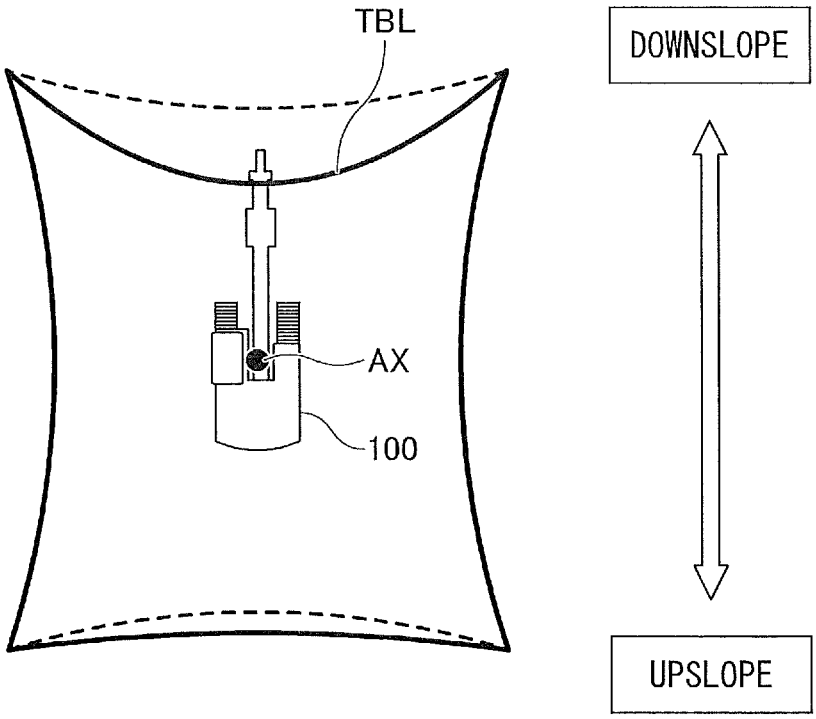
FIG. 9B is a plan view illustrating a specific example of a stable range of the attachment in view of the inclination of the work surface.

FIG. 9A and FIG. 9B are plan views illustrating specific examples of stable ranges of the attachment in view of the inclination of the work surface. Specifically, FIG. 9A is a plan view illustrating an example of a stable range of the attachment in view of the inclination of the work surface in a case where the work surface is a slope inclined in the lateral direction of the lower traveling body 1 (specifically, the right hand side of the slope is higher). FIG. 9B is a plan view illustrating another example of a stable range of the attachment in view of the inclination of the work surface in a case where the work surface is a slope inclined in the traveling direction of the lower traveling body 1 (specifically, the forward side of the slope in FIG. 9B is lower).

In FIG. 9A and FIG. 9B, similarly with the case of FIG. 8, the stable range of the attachment is set in view of the direction of the upper turning body 3 with respect to the lower traveling body 1. In FIG. 9A and FIG. 9B, broken lines adjacent to the stable range borders TBL indicate a stable range border that would be obtained if the work surface were not inclined (which are therefore equivalent to the stable range border TBL of FIG. 8).

As illustrated in FIG. 9A and FIG. 9B, as seen from the turn center AX of the shovel 100, the stable range border TBL is relatively closer in the downslope direction of the work surface, and the stable range border TBL is relatively farther in the upslope direction of the work surface. As seen from the turn center AX of the shovel 100, the stable range of the attachment is relatively narrower in the downslope direction of the work surface, and the stable range of the attachment is relatively wider in the upslope direction of the work surface. Specifically, as illustrated in FIG. 9A, the stable range of the attachment is relatively narrower in the left direction of FIG. 9A which is the downslope direction of the work surface, and the stable range of the attachment is relatively wider in the right direction of FIG. 9A which is the upslope direction of the work surface. As illustrated in FIG. 9B, the stable range of the attachment is relatively narrower in the forward direction of FIG. 9B which is the downslope direction of the work surface, and the stable range of the attachment is relatively wider in the backward direction of FIG. 9B which is the upslope direction of the work surface. As described above, when the direction of the attachment is in the downslope direction, the static overturning moment relatively increases, and the restraining moment relatively decreases, and conversely, when the direction of the attachment is in the upslope direction, the static overturning moment relatively decreases, and the restraining moment relatively increases.

The stable ranges of the attachment as illustrated in FIG. 8, FIG. 9A and FIG. 9B may be defined in view of the weight including the object such as a pile of earth on the bucket 6. In this case, with reference to the lower traveling body 1, the stable range of the attachment becomes relatively narrower when the weight including the object such as a pile of earth on the bucket 6 increases, and conversely, the stable range of the attachment becomes relatively wider when the weight including the object such as a pile of earth on the bucket 6 decreases.

Therefore, the stabilization control part 303 can perform the stabilization control for stabilizing the body of the shovel 100 on the basis of the stable ranges of the attachment illustrated in FIG. 8, FIG. 9A, and FIG. 9B. Specifically, in a case where the position of the bucket 6 as seen from the lower traveling body 1 is beyond the stable range border BL, the static unstable state determination part 302 determines that the body of the shovel 100 is in the static unstable state, and accordingly, the stabilization control part 303 moves the arm 5 in the closing direction according to the determination result. As a result, the stabilization control part 303 can reduce an occurrence of a predetermined unstable phenomenon such as the rear part lifting up phenomenon in the body of the shovel 100, while in view of the impact on the static stability of the body of the shovel 100 caused by the direction of the upper turning body 3 with respect to the lower traveling body 1, the inclination state of the work surface, the weight including the object on the bucket 6, and the like.

In the above example, in a case where the shovel 100 is in the dynamic unstable state or in the static unstable state, the controller 30 moves the arm 5 in the closing direction, but the operations are not limited thereto. For example, the controller 30 may move the arm 5 in the closing direction in a case where an unstable phenomenon such as the rear part lifting up phenomenon of the lower traveling body 1 and the like occurs (more specifically, immediately after an occurrence of such an unstable phenomenon). In this case, the controller 30 can reduce an increase of a predetermined unstable phenomenon, such as the rear part lifting up phenomenon of the lower traveling body 1 and the like, that has already occurred, and can settle the unstable phenomenon in a shorter period of time. In this case, on the basis of the detection value detected by the body angle sensor S4 and captured images captured by image-capturing devices provided on the upper turning body 3 to capture images around the shovel 100, the controller 30 may detect an occurrence of the rear part lifting up phenomenon of the lower traveling body 1 and the like. It is to be understood that the stabilization control of the shovel 100 according to the present example may be employed not only in the case where the shovel 100 is operated by an operator but also in the case where the shovel 100 is moved by the automatic drive function. This is also applicable to stabilization controls according to other examples of the shovel 100 explained below.

Another Example of Shovel

Subsequently, the another example of the shovel 100 is explained. Hereinafter, features different from the above example are mainly explained, and explanation about the same or corresponding features may be omitted.

<Configuration of Shovel>

The specific configuration of the shovel 100 is explained with reference to FIG. 10 and FIG. 11.

Figure 10:
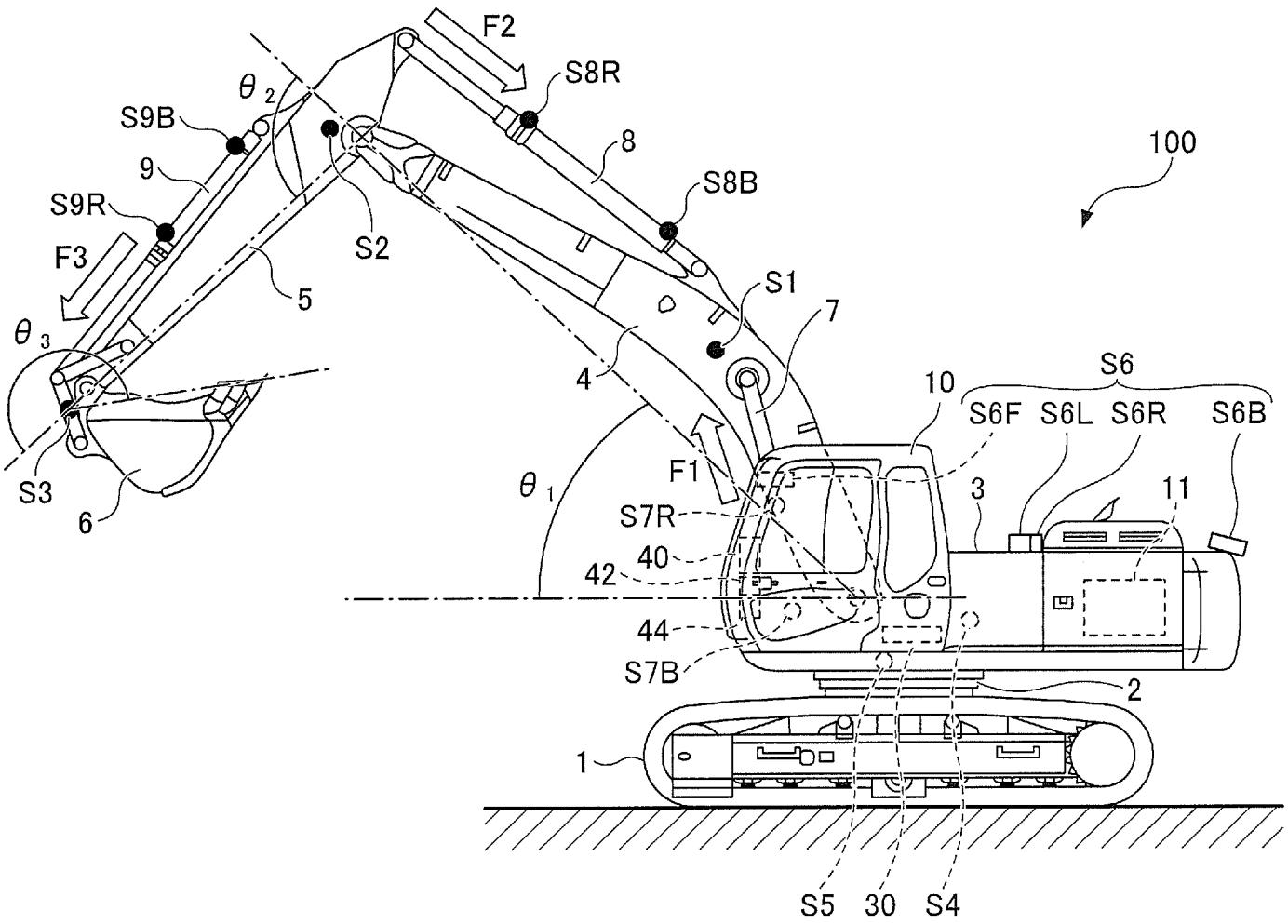
FIG. 10 is a side view illustrating another example of a shovel.

FIG. 10 is a side view illustrating the another example of the shovel 100 according to the present embodiment. FIG. 11 is a block diagram illustrating a fourth example of a configuration of the shovel 100 according to the present embodiment.

Figure 11:
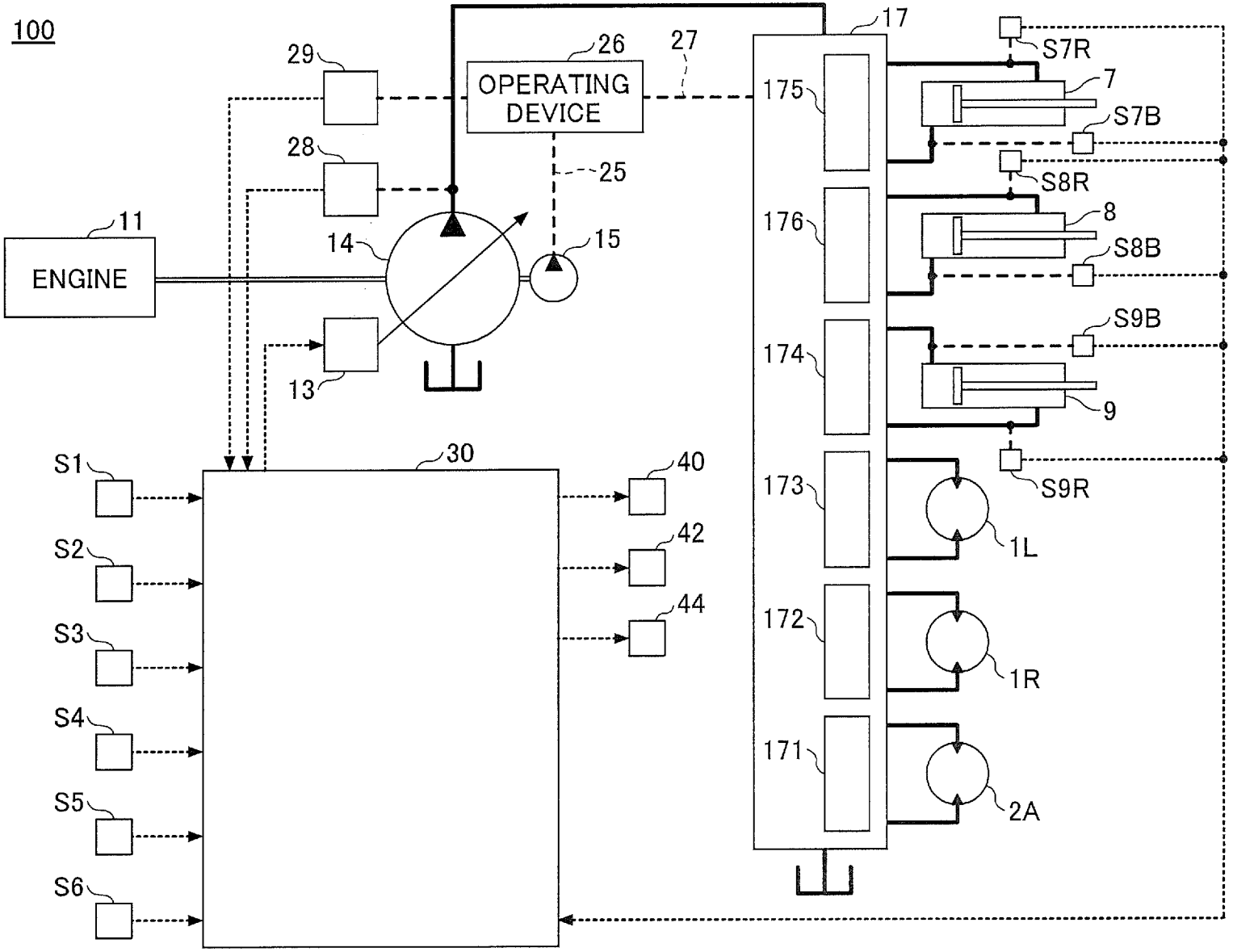
FIG. 11 is a block diagram illustrating a fourth example of a configuration of a shovel.

In FIG. 11, a mechanical power line, a high-pressure hydraulic line, a pilot line, and an electric drive and control system are indicated by a double line, a thick solid line, a dashed line, and a dotted line, respectively.

Similarly with the case of the example explained above, the hydraulic driving system of the shovel 100 according to the present example includes hydraulic actuators such as traveling hydraulic motors 1L, 1R, a turning hydraulic motor 2A, a boom cylinder 7, an arm cylinder 8, and a bucket cylinder 9 that hydraulically drive a lower traveling body 1, an upper turning body 3, a boom 4, an arm 5, and a bucket 6. Also, similarly with the case of the example explained above, the hydraulic driving system of the shovel 100 according to the present embodiment also includes an engine 11, a regulator 13, a main pump 14, and a control valve 17.

Similarly with the case of the example explained above, the control valve 17 is a hydraulic control device that controls the hydraulic actuators in response to operator's operations. In a manner as described above, the control valve 17 is connected via the high-pressure hydraulic line to the main pump 14, and selectively supplies the hydraulic oil supplied from the main pump 14 to the hydraulic actuators (the traveling hydraulic motors 1L, 1R, the turning hydraulic motor 2A, the boom cylinder 7, the arm cylinder 8, and the bucket cylinder 9) in response to the motion state of the operating device 26. Specifically, the control valve 17 includes control valves 171 to 176 that control the flowrates and the flow directions of hydraulic oil supplied from the main pump 14 to the respective hydraulic actuators. Specifically, a control valve 171 corresponds to the traveling hydraulic motor 1L, a control valve 172 corresponds to the traveling hydraulic motor 1R, a control valve 173 corresponds to the turning hydraulic motor 2A, a control valve 174 corresponds to the bucket cylinder 9, a control valve 175 corresponds to the boom cylinder 7, and a control valve 176 corresponds to the arm cylinder 8.

Similarly with the case of the example explained above, the operation system of the shovel 100 according to the present embodiment includes a pilot pump 15 and an operating device 26.

The control system of the shovel 100 according to the present embodiment includes a controller 30, a discharge pressure sensor 28, an operation pressure sensor 29, a display 40, an input device 42, a sound output device 44, a boom angle sensor S1, an arm angle sensor S2, a bucket angle sensor S3, a body angle sensor S4, a turn state sensor S5, an image-capturing device S6, a boom bottom pressure sensor S7B, a boom rod pressure sensor S7R, an arm bottom pressure sensor S8B, an arm rod pressure sensor S8R, a bucket bottom pressure sensor S9B, and a bucket rod pressure sensor S9R.

Similarly with the case of the example explained above, the controller 30 performs drive control of the shovel 100.

For example, in a case where there is a possibility that an unstable phenomenon in which the rear part of the shovel 100 (the lower traveling body 1) lifts up (hereinafter referred to as a "rear part lifting up phenomenon") may occur due to an aerial motion of the attachment based on the operator's operations, the controller 30 performs a stabilization control for reducing an occurrence of the rear part lifting up phenomenon.

For example, as described above, FIG. 6A and FIG. 6B are drawings illustrating specific examples of rear part lifting up phenomena of the shovel 100.

As illustrated in FIG. 6A, when the bucket 6 performs an opening motion in response to the operator's operations while the attachment is carrying the earth ES on the bucket 6 in the air, a reaction force, which is a dynamic disturbance of the opening motion, more particularly, an reaction moment (hereinafter referred to as an "overturning moment") is exerted on the upper turning body 3 by way of the attachment.

The overturning moment is exerted, around the ground contact point at the front end of the lower traveling body 1 (in the present example, the outer edge of one of the crawlers) serving as a fulcrum (hereinafter referred to as a "overturning fulcrum"), in a direction for causing the body of the shovel 100 (the lower traveling body 1 and the upper turning body 3) to overturn forward, i.e., in a direction for lifting the rear part of the lower traveling body 1. The overturning moment increases according to an increase in the distance of the position of the bucket 6 from the overturning fulcrum, i.e., according to an increase in the distance of the position of the bucket 6 from the body (the lower traveling body 1 and the upper turning body 3). Also, the overturning moment increases according to an increase in the velocity of the opening motion of the bucket 6 (specifically, according to an increase in the acceleration). Also, as illustrated in FIG. 6A, in a case where the direction of the upper turning body 3, i.e., the extension direction of the attachment from the upper turning body 3, is different from the traveling direction of the lower traveling body 1, the front end of the ground contact point of the lower traveling body 1 (overturning fulcrum) comes close to the center of the body, and accordingly, the position of the bucket 6 relatively moves farther away from the overturning fulcrum, which increases the overturning moment.

Therefore, depending on conditions such as the relationship in position of the bucket 6 with respect to the body, the weight including the object on the bucket 6, the acceleration of the opening motion of the bucket 6, and the direction of the upper turning body 3 with respect to the lower traveling body 1, the overturning moment relatively increases, and as illustrated in FIG. 6B, a rear part lifting up phenomenon of the shovel 100 may occur.

Therefore, in a case where there is a possibility that the rear part lifting up phenomenon may occur or in a case where the rear part lifting up phenomenon occurs, the controller 30 limits the motion of the bucket 6, so that the occurrence of the rear part lifting up phenomenon is reduced or the increase in the occurred rear part lifting up phenomenon is reduced. The stabilization control is explained later in detail.

The discharge pressure sensor 28 detects the discharge pressure of the main pump 14. A detection signal corresponding to the discharge pressure detected by the discharge pressure sensor 28 is input to the controller 30.

The turn state sensor S5 is attached to the upper turning body 3 to output detection information about the turn state of the upper turning body 3. For example, the turn state sensor S5 detects the turn angular speed and the turn angle of the upper turning body 3. The turn state sensor S5 includes, for example, a gyro sensor, a resolver, a rotary encoder, and the like. The detection information about the turn state detected by the turn state sensor S5 is input to the controller 30.

Note that the turn state sensor S5 may be omitted. This is because the body angle sensor S4 can output information about the turn state of the upper turning body 3 (turn angle). In the configuration of the body angle sensor S4, the function for outputting information about the turn state of the upper turning body 3 may be omitted.

The image-capturing device S6 captures images around the shovel 100. The image-capturing device S6 includes a camera S6F for capturing images at the front of the shovel 100, a camera S6L for capturing images at the left hand side of the shovel 100, a camera S6R for capturing images at the right hand side of the shovel 100, and a camera S6B for capturing images at the rear of the shovel 100.

For example, the camera S6F is attached to the inside of the cab 10, e.g., the ceiling of the cab 10. Alternatively, the camera S6F may be attached to the outside of the cab 10, e.g., the roof of the cab 10 and the side surface of the boom 4. The camera S6L is attached to the left end on the upper surface of the upper turning body 3, the camera S6R is attached to the right end on the upper surface of the upper turning body 3, and the camera S6B is attached to the rear end on the upper surface of the upper turning body 3.

Each of the image-capturing devices S6 (camera S6F, S6B, S6L, S6R) is a single-lens wide-angle camera having an extremely wide field of view. Alternatively, the image-capturing device S6 may include a stereo camera, a distance image sensor, and the like. Images captured by the image-capturing device S6 are input to the controller 30.

[Detail of Stabilization Control]

Subsequently, the stabilization control by the controller 30 is explained in detail with reference to FIG. 12.

Figure 12:
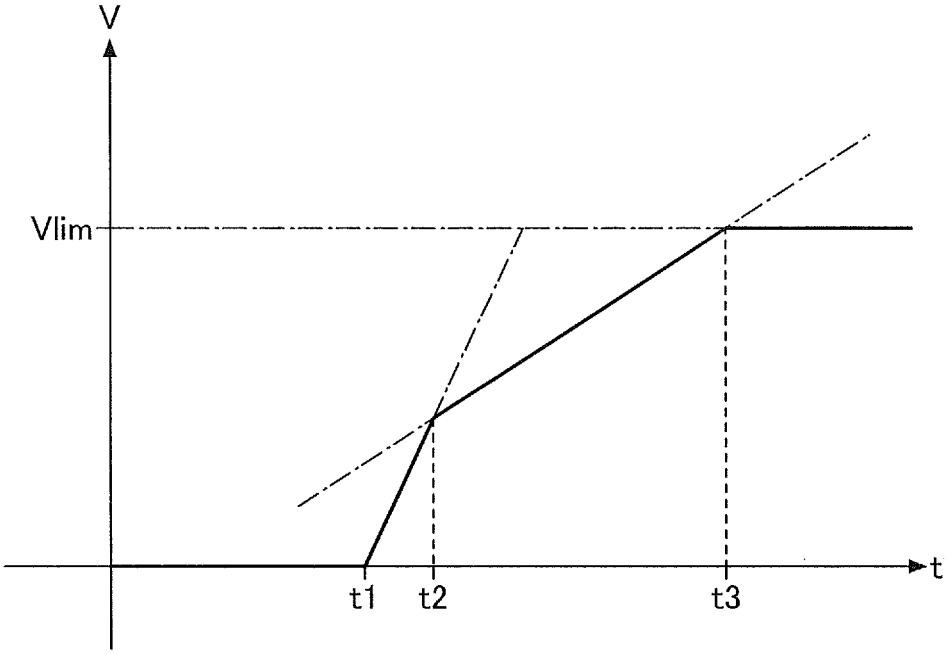
FIG. 12 is a graph for explaining an example of a control scheme of a stabilization control for reducing a rear part lifting up phenomenon.

FIG. 12 is a graph for explaining an example of a control scheme of a stabilization control for reducing the rear part lifting up phenomenon. Specifically, FIG. 12 represents temporal changes of a movement velocity V in a retracting direction of the bucket cylinder 9 limited by the stabilization control, i.e., the movement velocity V of the bucket cylinder 9 for driving the bucket 6 in the opening direction.

As described above, the rear part lifting up phenomenon of the shovel 100 may occur due to motions of the bucket 6 during aerial motion of the attachment.

To deal with this phenomenon, the controller 30 can delay the opening motion of the bucket 6 in a case where the rear part lifting up phenomenon of the shovel 100 may occur. Accordingly, the overturning moment for causing the shovel 100 to overturn forward caused by the opening motion of the bucket 6 during aerial motion of the attachment can be relatively reduced. Therefore, the controller 30 can reduce the occurrence of the rear part lifting up phenomenon of the shovel 100.

For example, the controller 30 sets a movement velocity (hereinafter simply referred to as a "movement velocity") V in the retracting direction of the bucket cylinder 9 and the upper limit value of the movement acceleration (hereinafter simply referred to as a "movement acceleration") a for reducing the occurrence of the rear part lifting up of the shovel 100, on the basis of a relationship between the overturning moment exerted on the body of the shovel 100 (the upper turning body 3) to cause the body to overturn forward and the restraining moment for reducing the body from overturning forward.

The overturning moment includes a static overturning moment (hereinafter referred to as a "static overturning moment") due to the weight of the attachment and a dynamic overturning moment (hereinafter referred to as a "dynamic overturning moment") due to motion of the attachment. Among them, the dynamic overturning moment depends on: the load state of the attachment, i.e., thrusts F1 to F3 of the boom cylinder 7, the arm cylinder 8, and the bucket cylinder 9, respectively; and the attitude state and the motion state of the attachment, i.e., the attitude angle, the angular speed, and the angular acceleration, about the fulcrum, of each of the boom 4, the arm 5, and the bucket 6. The restraining moment depends on: the weight of the body of the shovel 100 (the weight of the lower traveling body 1 and the upper turning body 3); the distance between the overturning fulcrum and each of the centers of gravities; and the like.

Therefore, the controller 30 can derive a calculation expression, for calculating the overturning moment, including, as variables, the movement velocity V and the movement acceleration $\alpha$ of the bucket cylinder 9 corresponding to the angular speed and the angular acceleration in the opening direction of the bucket 6, on the basis of the detection information about the load state, the attitude state, and the motion state of the attachment, i.e., the detection values detected by the sensors S1 to S4, S7B, S7R, S8B, S8R, S9B, S9R, and the like. The controller 30 can calculate the restraining moment on the basis of the weights of the lower traveling body 1 and the upper turning body 3 of the shovel 100, the distance between the overturning fulcrum and each of the centers of gravities, and the like. The controller 30 may define a conditional expression (hereinafter referred to as a "overturning restraining conditional expression") of the calculation expression of the overturning moment and the calculated value of the restraining moment in such a range that the overturning moment does not exceed the restraining moment, and may set an upper limit value (hereinafter referred to as an "upper limit movement velocity") Vlim of the movement velocity of the bucket cylinder 9 and an upper limit value (hereinafter referred to as an "upper limit movement acceleration") alim of the movement acceleration of the bucket cylinder 9, so as to satisfy the overturning restraining conditional expression. Also, the controller 30 may set the upper limits of the angular speed and the angular acceleration in the opening direction of the bucket 6 by using the calculation expression of the overturning moment including the angular speed and the angular acceleration of the bucket 6 as variables to perform conversion into the upper limit movement velocity Vlim and the upper limit movement acceleration alim of the bucket cylinder 9. Also, the controller 30 may derive the upper limit movement velocity Vlim and the upper limit movement acceleration alim of the bucket cylinder 9 directly from the detection values from the detection values detected by sensors S1 to S3, S7B, S7R, S8B, S8R, S9B, S9R, and the like by using conversion expressions and conversion maps defined in advance so as to satisfy the overturning restraining conditional expression between the calculation expression of the overturning moment and the calculated value of the restraining moment.

At every predetermined control cycle, the controller 30 derives the upper limit movement velocity Vlim and the upper limit movement acceleration alim. Then, the controller 30 performs the motion control of the bucket cylinder 9 so that the movement velocity V and the movement acceleration α of the bucket cylinder 9 become equal to or less than the upper limit movement velocity Vlim and the upper limit movement acceleration αlim, respectively. Specifically, the controller 30 outputs a control instruction to the regulator 13 to control (limit) the flowrate of the main pump 14, so that the movement velocity V and the movement acceleration α of the bucket cylinder 9 become equal to or less than the upper limit movement velocity Vlim and the upper limit movement acceleration αlim, respectively. In this case, the controller 30 controls the main pump 14 by using a previously defined control map, to which the upper limit movement velocity Vlim and the upper limit movement acceleration αlim that have been calculated have been applied, so that the movement velocity V and the movement acceleration α of the bucket cylinder 9 become equal to or less than the upper limit movement velocity Vlim and the upper limit movement acceleration αlim, respectively. Also, the controller 30 may apply, for example, feedback control and the like while monitoring measured values of the movement velocity and the movement acceleration of the bucket cylinder 9, so that the movement velocity V and the movement acceleration α of the bucket cylinder 9 become equal to or less than the upper limit movement velocity Vlim and the upper limit movement acceleration αlim, respectively. In this case, the controller 30 may monitor the movement velocity V and the movement acceleration α of the bucket cylinder 9, on the basis of the detection values detected by the cylinder sensors capable of detecting the position, the movement velocity, the movement acceleration, and the like of the cylinder attached to the bucket cylinder 9.

As illustrated in FIG. 12, in the present example, at a time t1, the bucket cylinder 9 starts to move in the retracting direction with a movement acceleration α being higher than the upper limit movement acceleration αlim.

Then, at a time t2, because the movement acceleration α is higher than the upper limit movement acceleration αlim, the controller 30 starts to limit the movement acceleration α of the bucket cylinder 9 to the upper limit movement acceleration αlim. Accordingly, the controller 30 can relatively slow the angular acceleration of the opening direction of the bucket 6, so that the controller 30 can reduce the occurrence of the rear part lifting up phenomenon of the shovel 100.

Then, at a time t3, when the movement velocity V of the bucket cylinder 9 attains the upper limit movement velocity Vlim, the controller 30 limits the movement velocity V of the bucket cylinder 9 so that the movement velocity V does not increase anymore. Therefore, the controller 30 can relatively slow the angular speed of the opening direction of the bucket 6, so that the occurrence of the rear part lifting up phenomenon of the shovel 100 can be further reduced.

In this example (FIG. 12), the upper limit movement velocity Vlim and the upper limit movement acceleration αlim are constant but are calculated with a predetermined control cycle, and therefore, as the time elapses, the upper limit movement velocity Vlim and the upper limit movement acceleration αlim may change.

As described above, the upper limit movement velocity Vlim and the upper limit movement acceleration αlim are set so as to satisfy the overturning restraining conditional expression. Therefore, even though the controller 30 does not specifically determine whether there is a possibility of occurrence of the rear part lifting up phenomenon of the shovel 100, the controller 30 can relatively slow the opening motion of the bucket 6 in a case where the rear part lifting up phenomenon of the lower traveling body 1 may possibly occur.

In a case where the weight including the object on the bucket 6 is relatively larger, for example, the bucket 6 is loaded with an object such as a pile of earth or the bucket 6 is replaced with a bucket with a different specification heavier than buckets of normal specifications, both of the static overturning moment and the dynamic overturning moment caused by the opening motion of the bucket 6 relatively increase, and accordingly, the rear part lifting up phenomenon of the lower traveling body 1 may occur. Also, in a case where the position of the bucket 6 is relatively distant from the overturning fulcrum, i.e., the lower traveling body 1, the static overturning moment relatively increases, and accordingly, when the dynamic overturning moment occurs due to the opening motion of the bucket 6, the rear part lifting up phenomenon of the lower traveling body 1 may occur. In a case where the attachment performs an unloading motion for unloading the object in the bucket 6 (for example, earth-unloading motion for unloading the earth ES as illustrated in FIG. 3), the weight including the object on the bucket 6 is relatively large, and the static overturning moment becomes relatively large, so that the dynamic overturning moment actually occurs due to the opening motion of the bucket 6, and therefore, the rear part lifting up phenomenon of the lower traveling body 1 may occur. In a case where a plurality of the above conditions (the condition on the position of the bucket 6, the condition on the weight including the object on the bucket 6, and the condition of the unloading motion for unloading the bucket 6) are satisfied at a time, the possibility of the occurrence of the rear part lifting up phenomenon of the lower traveling body 1 further increases. In such situations (hereinafter referred to as a "rear part lifting up situation"), the controller 30 can relatively slow the opening motion of the bucket 6 by limiting the movement velocity V and the movement acceleration α of the bucket cylinder 9 to be equal to or less than the upper limit movement velocity Vlim and the upper limit movement acceleration αlim.

Specifically, in a case where the controller 30 determines whether the rear part lifting up phenomenon of the shovel 100 may occur, and determines that the rear part lifting up phenomenon of the shovel 100 may occur, the controller 30 may slow the opening motion of the bucket 6. Accordingly, for example, the controller 30 may calculate the overturning moment of the shovel 100 on the basis of the detection values detected by the sensors S1 to S4, S7B, S7R, S8B, S8R, S9B, S9R, and the like, and in a case where the calculated values are more than a predetermined threshold value, the controller 30 may determine that the rear part lifting up phenomenon of the shovel 100 may occur. Also, the controller 30 may calculate the overturning moment of the shovel 100 and the restraining moment, and in a case where a subtraction value obtained by subtracting the calculated value of the overturning moment from the calculated value of the restraining moment is equal to or less than a predetermined threshold value, the controller 30 may determine that the rear part lifting up phenomenon of the shovel 100 may occur.

In a case where the shovel 100 is in the rear part lifting up situation explained above, the controller 30 may determine that the rear part lifting up phenomenon of the lower traveling body 1 may occur, and may slow the opening motion of the bucket 6. The controller 30 can limit the opening motion of the bucket 6 upon specifically identifying a situation in which the rear part lifting up phenomenon may occur. Therefore, the controller 30 can also achieve not only the alleviating of unstable phenomena but also the work efficiency of the shovel 100 by limiting a period of time in which the opening motion of the bucket 6 is possibly limited. Specifically, in a case where: the bucket 6 is loaded with an object such as a pile of earth; the bucket 6 is replaced with a bucket with a different specification heavier than buckets of normal specifications; or the weight including the object on the bucket 6 is relatively larger, the controller 30 may determine that the rear part lifting up phenomenon of the shovel 100 may occur. In this case, for example, the controller 30 may determine whether the bucket 6 is loaded with a pile of earth and the like on the basis of the captured images captured by the image-capturing device S6 (camera S6F). For example, the controller 30 can determine whether the bucket 6 is loaded with a pile of earth and the like on the basis of: the position of the bucket 6 calculated from the detection values detected by the boom angle sensor S1, the arm angle sensor S2, and the bucket angle sensor S3, known link lengths of the boom 4, the arm 5, and the bucket 6, and the like; the absolute attitude state of the bucket 6 from an external viewpoint; and the like. Also, the controller 30 may determine whether the bucket 6 is a bucket with a different specification heavier than buckets of normal specifications on the basis of, for example, information about the type of the currently attached bucket 6 that is configured and input by the operator with the input device 42. Also, the controller 30 may determine that the rear part lifting up phenomenon of the lower traveling body 1 may occur, in a case where the position of the bucket 6 is relatively distant from the lower traveling body 1 (more specifically, in a case where the position of the bucket 6 is more than a predetermined threshold value). In this case, as described above, the controller 30 may ascertain the position of the bucket 6 on the basis of: for example, the detection values detected by the boom angle sensor S1, the arm angle sensor S2, and the bucket angle sensor S3; known link lengths of the boom 4, the arm 5, and the bucket 6; and the like. Also, the controller 30 may determine that the rear part lifting up phenomenon of the lower traveling body 1 may occur, in a case where the attachment performs the unloading motion for unloading the object in the bucket 6. In this case, the controller 30 may determine whether the attachment performs the unloading motion for unloading the object in the bucket 6, on the basis of: the current attitude state of the attachment that is ascertained from the detection values detected by the boom angle sensor S1, the arm angle sensor S2, and the bucket angle sensor S3; and the motion state of the shovel 100 immediately before the current motion state (for example, whether a turn motion is performed in such an attitude state of the attachment that the earth and the like are loaded in the bucket 6).

Also, in a case where the shovel 100 is in the rear part lifting up situation explained above, and further, the controller 30 determines that the possibility of the occurrence of the rear part lifting up phenomenon of the lower traveling body 1 is relatively higher, the controller 30 may slow the opening motion of the bucket 6. Accordingly, the controller 30 can limit the motions of the bucket 6 upon identifying a situation in which the rear part lifting up phenomenon may occur and ascertaining that the possibility of the occurrence of the rear part lifting up phenomenon relatively increases. Therefore, the controller 30 can further limit the period of time in which the opening motion of the bucket 6 can be limited, and can improve the work efficiency of the shovel 100.

Also, instead of controlling the main pump 14, the controller 30 may slow the opening motion of the bucket 6 according to other methods.

Figure 13:
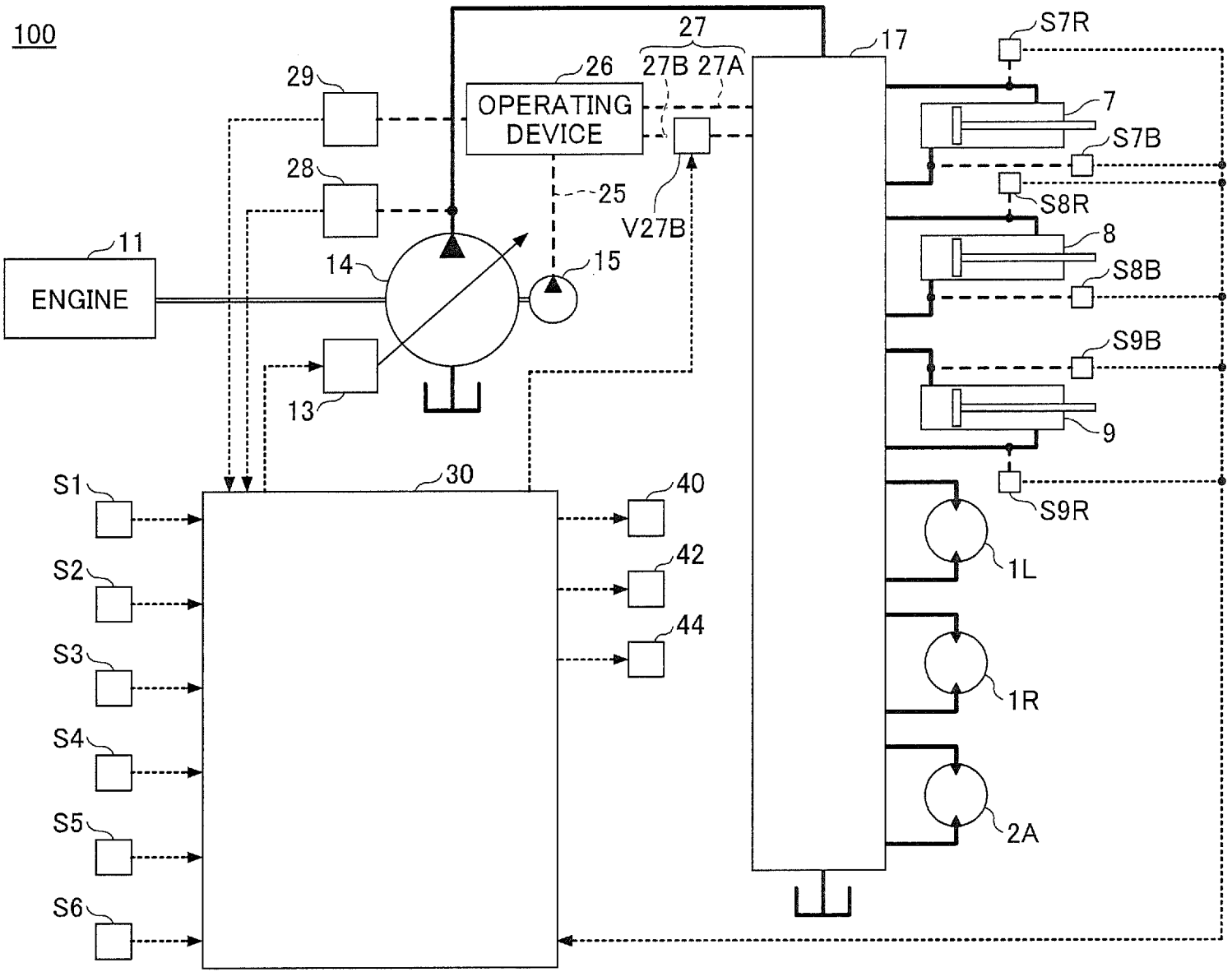
FIG. 13 is a block diagram illustrating a fifth example of a configuration of a shovel.
Figure 14:
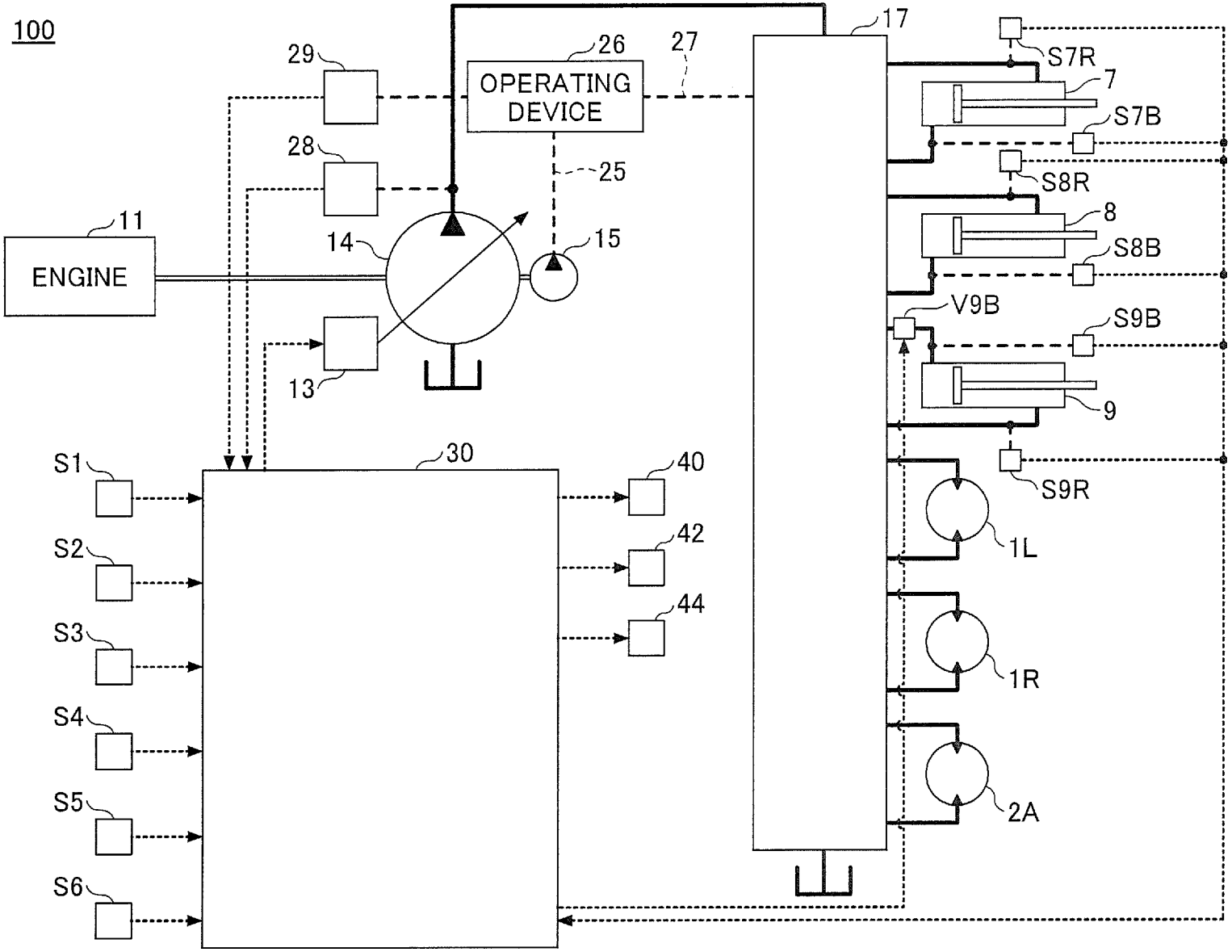
FIG. 14 is a block diagram illustrating a sixth example of a configuration of a shovel.

For example, FIG. 13 and FIG. 14 are block diagrams illustrating the fifth example and the sixth example of the configurations of the shovel 100 according to the present embodiment.

As illustrated in FIG. 13, in the present example, a pressure-reducing valve V27B is provided in the pilot line 27 between the operating device 26 and the control valve 17. Specifically, from among a pilot line 27A corresponding to operations other than the opening motion of the bucket 6 and a pilot line 27B corresponding to the opening motion of the bucket 6, the pressure-reducing valve V27B is provided in the pilot line 27B. In a case where the pressure-reducing valve V27B does not receive a control instruction from the controller 30, the pressure-reducing valve V27B applies, to the control valve 174 corresponding to the bucket cylinder 9 in the control valve 17, the pilot pressure corresponding to motions of the bucket 6, which are output from the operating device 26 to the pilot line 27B, without changing the pilot pressure. In a case where the pressure-reducing valve V27B receives a control instruction from the controller 30, the pressure-reducing valve V27B reduces the pilot pressure corresponding to motions of the bucket 6, which are output from the operating device 26 to the pilot line 27B according to the received control instruction, and applies the reduced pilot pressure to the control valve 174 corresponding to the bucket cylinder 9 in the control valve 17. Accordingly, the pressure-reducing valve V27B can apply, to the control valve 174 corresponding to the bucket cylinder 9 in the control valve 17, a pilot pressure corresponding to an amount of operation smaller than the actual amount of operation of the operating device 26 by the operator for operating the bucket 6. Therefore, the controller 30 can limit the opening motion of the bucket 6 and relatively slow the motion of the bucket 6 by outputting the control instruction to the pressure-reducing valve V27B.

Also, as illustrated in FIG. 14, in the present example, a flowrate control valve V9B is provided in the high-pressure hydraulic line between the bottom-side oil chamber of the bucket cylinder 9 and the control valve 17.

In a case where the flowrate control valve V9B (an example of a throttle valve) receives a control instruction from the controller 30, the flowrate control valve V9B limits (reduces) the flowrate of hydraulic oil discharged from the bottom-side oil chamber of the bucket cylinder 9 to the control valve 17 according to the control instruction. Accordingly, the flowrate control valve V9B can relatively slow the movement velocity of the retracting direction of the bucket cylinder 9 corresponding to the opening motion of the bucket 6. Therefore, the controller 30 can limit the opening motion of the bucket 6 and can relatively slow the motion of the bucket 6 by outputting the control instruction to the flowrate control valve V9B.

In a case where the controller 30 limits the motion of the bucket 6, the controller 30 may notify that motions of the bucket 6 are being limited (i.e., the stabilization control is being performed) regardless of operator's operations. Specifically, the controller 30 may give the notification to the operator by outputting the control instruction to the display 40 and the sound output device 44 using visual image information and audible sound information. Accordingly, in a case where motions of the bucket 6 are being limited, the operator can be notified to that effect, and therefore, the controller 30 can alleviate the unpleasantness felt by the operator when motions of the bucket 6 are limited without being intended by the operator.

In the another example explained above, motions of the bucket 6 are limited, but similar motion limitation may also be performed in a case where attachments of other types are attached. In other words, the contents of control according to the another example explained above may be applied to the case where any given end attachment is attached to the end of the arm 5.

Still Another Example of Shovel

Subsequently, still another example of the shovel 100 is explained.

The example and the another example of the shovel 100 explained above may be combined as necessary. In other words, the shovel 100 may include both of the contents specific to the example and the another example explained above.

For example, in order to reduce the rear part lifting up phenomenon of the lower traveling body 1, the shovel 100 may have both of the function for correcting motions of the arm 5 and moving the arm 5 in the closing direction and the function for correcting motions of the bucket 6 and relatively slowing the movement velocity.

Accordingly, the shovel 100 can further reduce the occurrence of the rear part lifting up phenomenon of the lower traveling body 1 and further reduce the increase in the occurred rear part lifting up phenomenon.

[Configuration of Shovel Management System]

Subsequently, a configuration of a shovel management system SYS is explained with reference to FIG. 15.

Figure 15:
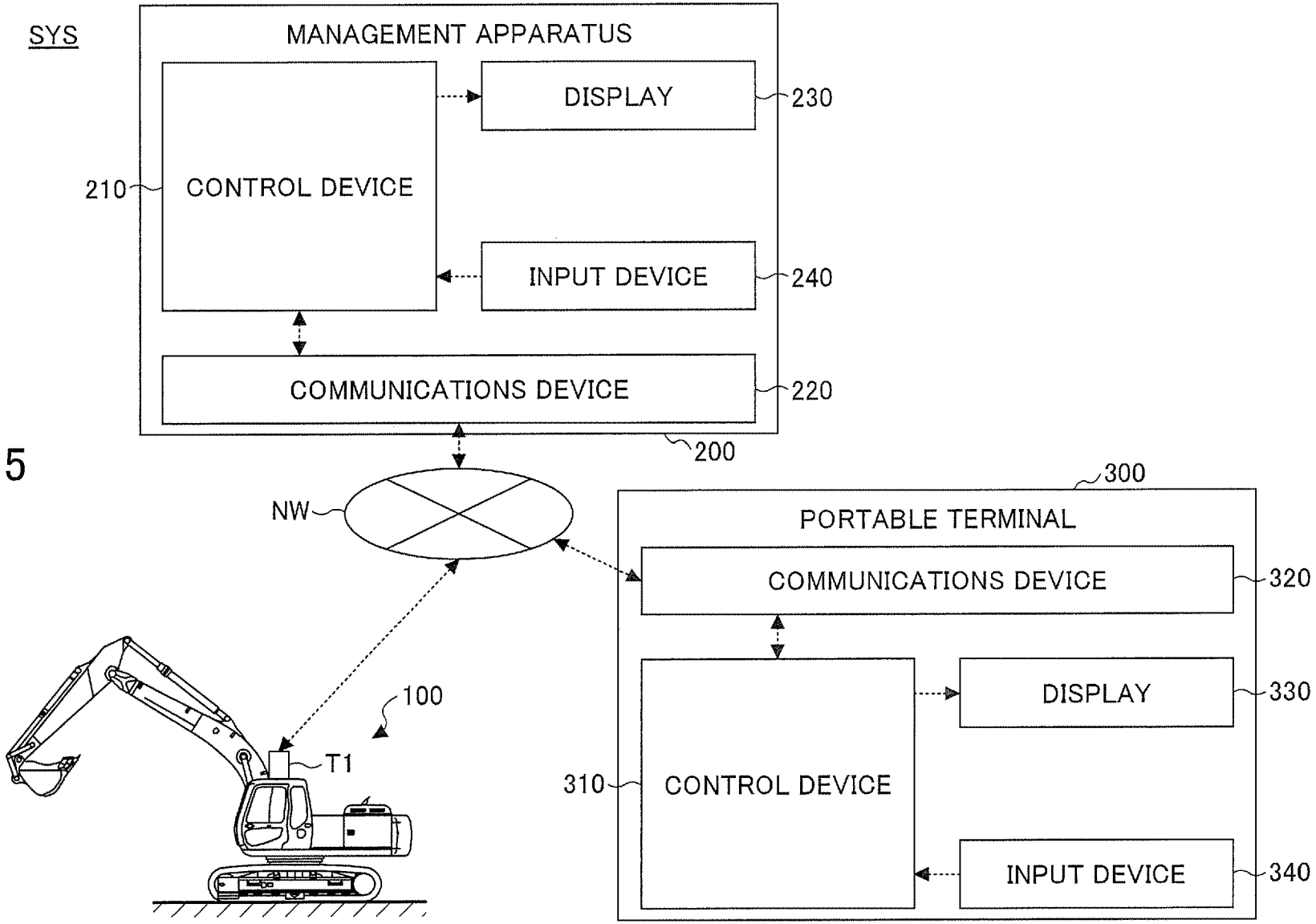
FIG. 15 is a diagram illustrating an example of a configuration of a shovel management system.

As illustrated in FIG. 15, the shovel 100 may be a constituent element of the shovel management system SYS.

The shovel management system SYS includes a shovel 100, a management apparatus 200, and a portable terminal 300. The shovel management system SYS may include one or more shovels 100. The shovel management system SYS include one or more portable terminals 300.

For example, the shovel management system SYS collects various kinds of information from the shovel 100 in the management apparatus 200, and monitors motion circumstances of the shovel 100 and whether a malfunctions occurs. For example, the shovel management system SYS distributes various kinds of information about the shovel 100 from the management apparatus 200 to the portable terminal 300, and transmits control instructions from the management apparatus 200 to the shovel 100.

<Configuration of Shovel>

As illustrated in FIG. 15, the shovel 100 includes a communication device T1, and is configured to be able to communicate with the management apparatus 200.

The communication device T1 communicates via a predetermined communication network NW to an external device (for example, the management apparatus 200) of the shovel 100. For example, the communication network NW may include a mobile communication network including a base station as a terminal end. For example, the communication network NW may include a satellite communication network using a communications satellite. For example, the communication network NW may include the Internet. For example, the communication network NW may include short range communication networks based on standards such as Bluetooth (registered trademark), Wi-Fi, and the like. For example, the communication device T1 uploads (transmits) various kinds of information obtained by the shovel 100 to the management apparatus 200 under the controls of the controller 30. Also, for example, the communication device T1 receives information transmitted from the management apparatus 200 through the communication network NW. Information received by the communication device T1 is input to the controller 30.

The configuration of the shovel 100 other than the communication device T1 may be expressed in, for example, FIG. 2 to FIG. 4, FIG. 11, FIG. 13, FIG. 14, and the like. Accordingly, the explanation about the other configuration is omitted.

<Configuration of Management Apparatus>

The management apparatus 200 is arranged outside of the shovel 100. For example, the management apparatus 200 is a server arranged at a location other than the work site where the shovel 100 performs work. The server may be a cloud server or may be an edge server. Also, for example, the management apparatus 200 may be a management terminal provided in a site office of a work site where the shovel 100 performs work.

The management apparatus 200 includes a control device 210, a communication device 220, a display 230, and an input device 240.

The control device 210 performs various kinds of control of operations of the management apparatus 200. The functions of the control device 210 may be implemented by any hardware, or a combination of hardware and software. The control device 210 is constituted mainly by a computer including, for example, a CPU, memory devices such as a RAM, an auxiliary storage device such as a ROM, an interface device for various kinds of inputs and outputs, and the like. This is also applicable to a control device 310 of the portable terminal 300 explained later.

The communication device 220 communicates with a predetermined external device (for example, the shovel 100 and the portable terminal 300) through the communication network NW. For example, the communication device 220 transmits various kinds of information and control instructions to the shovel 100 and the portable terminal 300 under the control of the control device 210. Also, for example, the communication device 220 receives information transmitted (uploaded) from the shovel 100 and the portable terminal 300. The information received by the communication device 220 is input to the control device 210.

The display 230 displays various kinds of information image for the administrator of the management apparatus 200, workers, and the like (hereinafter referred to as "an administrator and the like") under the control of the control device 210. For example, the display 230 is an organic EL (Electroluminescence) display and a liquid crystal display. This is also applicable to a display 330 of the portable terminal 300 explained later.

The input device 240 receives operation inputs from the administrator and the like of the management apparatus 200, and outputs the operation inputs to the control device 210. For example, the input device 240 includes operation input means of any given hardware such as buttons, toggle switches, levers, a joystick, a keyboards, a mouse, a touch panel, and the like. The input device 240 may include virtual operation input means (for example, button icons and the like) displayed on the display 230 and operable with operation input means (for example, touch panels). This is also applicable to an input device 340 of the portable terminal 300 explained later.

In the present example, some of the functions of the shovel 100 (the controller 30) explained above may be provided in the control device 210 of the management apparatus 200.

For example, the functions of the dynamic unstable state determination part 301, the static unstable state determination part 302, and the stabilization control part 303 in the example of the shovel 100 explained above may be provided in the management apparatus 200 (the control device 210).

For example, the control device 210 may monitor (determine) whether the body of the shovel 100 is in the dynamic unstable state and in the static unstable state on the basis of information uploaded from the shovel 100 according to a method similar to the above. Then, in a case where the control device 210 determines that the shovel 100 is in the dynamic unstable state or in the static unstable state, the control device 210 may transmit, to the shovel 100 by way of the communication device 220, a control instruction for instructing the shovel 100 to release the pressure in the rod-side oil chamber of the arm cylinder 8.

Also, for example, the control device 210 may sequentially transmit, to the portable terminal 300, information about the monitoring result (the determination result) as to whether the body of the shovel 100 is in the dynamic unstable state or in the static unstable state. Accordingly, the administrator of the shovel 100 who has the portable terminal 300, the supervisor of the work site, and the like can ascertain the stable state from the outside of the shovel 100.

Also, for example, the functions of the stabilization control in the another example of the shovel 100 explained above may be provided in the management apparatus 200 (the control device 210).

For example, the control device 210 can determine (monitor) whether the rear part lifting up phenomenon of the shovel 100 may occur, according to a method similar to the above, on the basis of information uploaded from the shovel 100. Then, in a case where the control device 210 determines that the rear part lifting up phenomenon of the shovel 100 may occur, the control device 210 may transmit, to the shovel 100 by way of the communication device 220, a control instruction for instructing the shovel 100 to relatively slow the opening motion of the end attachment.

For example, the control device 210 may sequentially transmit, to the portable terminal 300, information about the monitoring result (the determination result) as to whether the rear part lifting up phenomenon occurs in the shovel 100. Accordingly, the administrator of the shovel 100 who has the portable terminal 300, the supervisor of the work site, and the like can ascertain the stable state from the outside of the shovel 100.

<Configuration of Portable Terminal>

The portable terminal 300 is operated by the owner of the shovel 100, the administrator, the supervisor of the work site, the operator, and the like. For example, the portable terminal 300 may be a cellular phone, a smartphone, a tablet terminal, a laptop type computer terminal, and the like.

The portable terminal 300 includes the control device 310, a communication device 320, a display 330, and an input device 340.

The control device 310 performs various kinds of control of operations of the portable terminal 300.

The communication device 320 communicates with a predetermined external device (for example, the management apparatus 200) via the communication network NW. For example, the communication device 320 transmits various kinds of information to the management apparatus 200 under the control of the control device 310. For example, the communication device 320 receives information transmitted (downloaded) from the management apparatus 200. The information received by the communication device 320 is input to the control device 310.

The display 330 displays various kinds of information image for the user of the portable terminal 300 under the control of the control device 310.

The input device 340 receives operation inputs from the user of the portable terminal 300, and outputs the operation inputs to the control device 310.

The user of the portable terminal 300 performs a predetermined operation with the input device 340, and starts a predetermined application program (hereinafter referred to as a "shovel stable state viewing application") installed on the control device 310. Then, the user of the portable terminal 300 performs, with the input device 340, an operation for transmitting, to the management apparatus 200, a request signal for requesting viewing of the monitoring result of the stable state of the shovel 100 on a predetermined application screen corresponding to the shovel stable state viewing application. The control device 310 transmits the request signal to the management apparatus 200 through the communication device 320 in response to the operation. Accordingly, the management apparatus 200 sequentially transmits, to the portable terminal 300, the monitoring result (the determination result) about the stable state of the shovel 100 with every predetermined control cycle in response to the request signal from the portable terminal 300. Accordingly, the user of the portable terminal 300 can ascertain the stable state the shovel 100 from the outside of the shovel 100.

Also, the portable terminal 300 may be configured to be able to directly communicate with the shovel 100 through the communication device 320. In this case, the functions of the dynamic unstable state determination part 301, the static unstable state determination part 302, and the stabilization control part 303 in the example of the shovel 100 explained above and the functions of the stabilization control of the another example of the shovel 100 explained above may be provided in the control device 310 of the portable terminal 300.

[Actions]

Subsequently, the actions of the shovel 100 according to the present embodiment are explained.

In the present embodiment, the controller 30 corrects the motion of the arm 5 or the end attachment according to the stable state of the body of the shovel 100. Specifically, in a case where the stability of the body of the shovel 100 is relatively high, the controller 30 causes the arm 5 and the end attachment to perform operations according to the operation contents or the motion instructions of the automatic drive function. Conversely, in a case where the stability of the body of the shovel 100 is relatively low, the controller 30 may correct the motion of the arm 5 or the end attachment in such a manner as to recover the stability more greatly than the stability obtained through the operation contents or operations according to the motion instructions of the automatic drive function.

Accordingly, the stability of the body of the shovel 100 can be recovered in such a manner as to relatively increase the stability during aerial motion of the attachment. Therefore, the controller 30 can reduce an unstable phenomenon that could occur in the body of the shovel 100 during aerial motion of the attachment.

Note the controller 30 may correct not only the motion of the arm 5 or the end attachment but also the motion of the boom 4 according to the stable state of the shovel 100. For example, in a case where there is a possibility that the rear part lifting up phenomenon may occur, the controller 30 may release the pressure of the bottom-side oil chamber of the boom cylinder 7. Accordingly, the boom cylinder 7 serves as a cushion to reduce the occurrence of the rear part lifting up phenomenon.

In the present embodiment, the controller 30 may move the arm 5 in the closing direction according to motions of the shovel 100.

Therefore, even when, during aerial motion of the attachment, the shovel 100 performs a motion that exerts a dynamic overturning moment to the body, at least a portion of a dynamic disturbance (dynamic overturning moment) caused by the motion of the shovel 100 is absorbed by the operation corresponding to the extension direction of the arm cylinder 8, i.e., the closing direction of the arm 5, so the dynamic overturning moment is less likely to be exerted on the body of the shovel 100. Also, even in a case where there is a change in a static moment (a static overturning moment and a restraining moment) according to the motion of the shovel 100 during aerial motion of the attachment, a relative increase in the static overturning moment can be reduced. Therefore, the controller 30 can specifically reduce an unstable phenomenon that could occur in the body of the shovel 100 during aerial motion of the attachment.

The controller 30 may reduce an unstable phenomenon other than the rear part lifting up phenomenon. For example, as illustrated in FIG. 6A, in a case where the motion of the attachment is performed to unload the object on the bucket 6 to the outside, a dynamic disturbance due to the motion of the attachment may cause the body of the shovel 100 to vibrate as an unstable phenomenon. Even in such a case, by moving the arm 5, at least a portion of the dynamic disturbance due to the motion of the shovel 100 (the attachment) is absorbed, so that the vibration of the body of the shovel 100 can be reduced.

Also, in the present embodiment, the controller 30 may move the arm 5 in the closing direction so as to reduce a dynamic moment (a dynamic overturning moment) that could be exerted on the body of the shovel 100 according to motions of the shovel 100.

Accordingly, specifically, the controller 30 can reduce an unstable phenomenon that could occur in the body during aerial motion of the attachment in such a manner as to take measures against a dynamic disturbance that could be exerted on the body of the shovel according to motions of the shovel 100.

In, the present embodiment, in a case where the attachment performs a motion to unload the object on the bucket 6, the controller 30 may move the arm 5 in the closing direction.

Therefore, the controller 30 can reduce the occurrence or increase of the unstable phenomenon in a specific situation in which a dynamic moment (a dynamic overturning moment) could occur.

Also, in the present embodiment, the controller 30 may move the arm 5 in the closing direction in a case where the lower traveling body 1 rapidly decelerates in a state in which the lower traveling body 1 is travelling with its attachment being oriented in the traveling direction.

Accordingly, the controller 30 can reduce the occurrence or increase of the unstable phenomenon in a specific situation in which a dynamic moment (a dynamic overturning moment) could occur.

In, the present embodiment, in a case where the amount of forward tilt of the body rapidly increases in a state in which the lower traveling body 1 is travelling with its attachment being oriented in the traveling direction, the controller 30 may move the arm 5 in the closing direction.

Accordingly, the controller 30 can reduce the occurrence or increase of the unstable phenomenon in a specific situation in which a dynamic moment (a dynamic overturning moment) could occur.

Also, in the present embodiment, the controller 30 may move the arm 5 in the closing direction so as to reduce the change in a static moment (a static overturning moment and a restraining moment) exerted on the body according to motions of the shovel 100.

Accordingly, specifically, the controller 30 can reduce an unstable phenomenon that could occur in the body during aerial motion of the attachment in such a manner as to take measures against the change in a static moment (a static overturning moment and a restraining moment) exerted on the body according to motions of the shovel 100.

Also, in the present embodiment, the controller 30 may move the arm 5 in the closing direction according to the lowering motion of the boom 4 in a state in which the bucket 6 is relatively distant from the body.

Accordingly, the controller 30 can reduce the occurrence or increase of the unstable phenomenon in a specific situation in which a static moment could change.

Also, in the present embodiment, the controller 30 may move the arm 5 in the closing direction according to a motion that the attachment loads and raises the target object such as a pile of earth on the bucket 6.

Accordingly, the controller 30 can reduce the occurrence or increase of the unstable phenomenon in a specific situation in which a static moment could change.

Also, in the present embodiment, the controller 30 may move the arm 5 in the closing direction according to turning of the upper turning body 3 so that the direction of the attachment moves away from the traveling direction of the lower traveling body 1.

Accordingly, the controller 30 can reduce the occurrence or increase of the unstable phenomenon in a specific situation in which a static moment could change.

Also, in the present embodiment, the controller 30 may move the arm 5 in the closing direction according to an increase in the amount of forward tilt of the body of the shovel 100 in a state in which the lower traveling body 1 is travelling with its attachment being oriented in the traveling direction.

Accordingly, the controller 30 can reduce the occurrence or increase of the unstable phenomenon in a specific situation in which a static moment could change.

Also, in the present embodiment, the controller 30 may move the arm 5 in the closing direction by its own weight by causing the relief valve V8R to release the pressure in the rod-side oil chamber of the arm cylinder 8 according to motions of the shovel 100.

Accordingly, the controller 30 can cancel a static unstable state and a dynamic unstable state of the shovel 100 by moving the arm 5 by its own weight.

Also, in the present embodiment, the controller 30 may activate the release function of the relief valve V8R for releasing the pressure of the hydraulic oil in the arm cylinder 8 by deactivating the holding function of the hydraulic oil holding circuit 90 for holding the hydraulic oil of the rod-side oil chamber of the arm cylinder 8 according to motions of the shovel 100.

Accordingly, the controller 30 can cause the relief valve V8R to release the pressure in the rod-side oil chamber of the arm cylinder 8 even in a case where the hydraulic oil holding circuit 90 is provided on the upstream side of the relief valve V8R, i.e., on the side of the arm cylinder 8, to prevent the arm 5 from falling. Therefore, the shovel 100 can achieve both of the falling prevention function of the arm 5 (the holding function for holding the hydraulic oil of the rod-side oil chamber of the arm cylinder 8) and the function of the stabilization control for stabilizing the body of the shovel 100 (the release function for releasing the pressure of the arm cylinder 8).

Also, in the present embodiment, the controller 30 can relatively slow the opening motion of the end attachment (the bucket 6) in a case where there is a possibility that the rear part lifting up phenomenon of the lower traveling body 1 occurs.

Accordingly, a dynamic overturning moment exerted on the upper turning body 3 due to the opening motion of the end attachment (the bucket 6) can be reduced, and the rear part lifting up phenomenon of the lower traveling body 1 due to the opening motion of the bucket in the air can be reduced.

Note that the controller 30 may slow the opening motion of the bucket 6 in a case where the rear part lifting up phenomenon of the lower traveling body 1 occurs. Accordingly, the increase of the rear part lifting up phenomenon of the lower traveling body 1 having already occurred can be reduced, and the rear part lifting up phenomenon can be settled in a shorter period of time. In this case, the controller 30 may detect the occurrence of the rear part lifting up phenomenon of the lower traveling body 1 on the basis of the detection value detected by the body angle sensor S4 and the captured image captured by the image-capturing device S6.

Also, in the present embodiment, the controller 30 may relatively slow the opening motion of the bucket 6 in a case where the weight of the end attachment (the weight including the object in the case of the bucket 6) is relatively larger, or in a case where the position of the end attachment is relatively distant from the lower traveling body 1.

Accordingly, the controller 30 can reduce the occurrence of the rear part lifting up phenomenon of the lower traveling body 1 by in specific circumstances in which the static overturning moment is relatively large and there is a high possibility that the rear part lifting up phenomenon of the lower traveling body 1 may occur due to the opening motion of the end attachment. Also, under the same circumstances, the controller 30 can reduce the increase in the rear part lifting up phenomenon that has occurred and can settle the rear part lifting up phenomenon in a shorter period of time.

Also, in the present embodiment, the controller 30 may relatively slow the opening motion of the bucket 6 in a case where the attachment performs the unloading motion for unloading the object in the bucket 6.

Accordingly, the controller 30 can reduce the occurrence of the rear part lifting up phenomenon of the lower traveling body 1 in specific circumstances in which the opening motion of the bucket 6 is performed, and it is highly possible that a dynamic overturning moment could be exerted on the upper turning body 3. Similarly, the controller 30 can reduce the increase of the rear part lifting up phenomenon that has occurred under the same circumstances, and can settle the rear part lifting up phenomenon in a shorter period of time.

Also, in the present embodiment, the controller 30 may slow the opening motion of the bucket 6 in a case where the position of the bucket 6 is relatively distant from the lower traveling body 1 and the attachment performs the unloading motion for unloading the object in the bucket 6.

Accordingly, the controller 30 can reduce the occurrence of the rear part lifting up phenomenon of the lower traveling body 1 in specific circumstances in which the static overturning moment is relatively large, and the opening motion of the bucket 6 is performed, so that a dynamic overturning moment is exerted on the upper turning body 3, and there is an extremely high possibility that the rear part lifting up phenomenon of the lower traveling body 1 occurs. Similarly, the controller 30 can reduce the increase of the rear part lifting up phenomenon that has occurred under the same circumstances, and can settle the rear part lifting up phenomenon in a shorter period of time.

Also, in the present embodiment, the controller 30 may slow the opening motion of the bucket 6 when, in a case where the attachment performs the unloading motion for unloading the object in the bucket 6, there is a relatively high possibility that the rear part lifting up phenomenon of the lower traveling body 1 may occur or the rear part lifting up phenomenon of the lower traveling body 1 occurs.

Accordingly, motions of the bucket 6 are not limited until there is a relatively high possibility that the rear part lifting up phenomenon of the lower traveling body 1 may occur, or the rear part lifting up phenomenon of the lower traveling body 1 actually occurs. Therefore, while the controller 30 can reduce the rear part lifting up phenomenon, the work efficiency of the shovel 100 can be improved.

Also, in the present embodiment, the controller 30 may relatively slow the opening motion of the end attachment by causing the main pump 14, which supplies hydraulic oil to the bucket cylinder 9 (an example of the end attachment cylinder) through the regulator 13, to limit the flowrate of hydraulic oil. Also, the controller 30 may relatively slow the opening motion of the end attachment by causing the control valve 174 in the control valve 17, which controls the flowrate of the hydraulic oil supplied through the pressure-reducing valve V27B from the main pump 14 to the bucket cylinder 9, to limit the flowrate to the bucket cylinder 9. Also, the controller 30 may relatively slow the opening motion of the end attachment by causing the flowrate control valve (the throttle valve) V9R to reduce the flowrate of hydraulic oil discharged from (the bottom-side oil chamber of) the bucket cylinder 9.

Accordingly, specifically, the controller 30 can relatively slow the opening motion of the end attachment by limiting the hydraulic oil supplied to the bucket cylinder 9.

Also, in the present embodiment, the controller 30 may relatively slow the opening motion of the end attachment by limiting the movement velocity V and the movement acceleration $\alpha$ of the bucket cylinder 9 to those equal to or less than a predetermined upper limit value.

Accordingly, the controller 30 can achieve a specific control aspect for relatively slowing the opening motion of the end attachment.

Note that the controller 30 may set an upper limit value for any one of the movement velocity V and the movement acceleration $\alpha$ of the bucket cylinder 9, and may limit the any one of the movement velocity V and the movement acceleration $\alpha$ of the bucket cylinder 9 to equal to or less than the upper limit value.

Also, in the present embodiment, the controller 30 calculates the upper limit value (the upper limit movement velocity Vlim and the upper limit movement acceleration $\alpha$lim) of at least one of the movement velocity and the movement acceleration of the bucket cylinder 9 on the basis of the detection information of predetermined sensors (the sensors S1 to S4, S7B, S7R, S8B, S8R, S9B, S9R, and the like) that detect the state of the attachment.

Accordingly, the controller 30 can calculate the upper limit value in view of the attitude state of the attachment, the motion state, and the like affecting the static overturning moment and the dynamic overturning moment. Therefore, the controller 30 can more appropriately limit the opening motion of the end attachment according to the circumstances at that time.

Also, in the present embodiment, the controller 30 calculates the overturning moment in the direction to lift up the rear part of the lower traveling body 1 and the restraining moment in the direction to reduce the rear part of the lower traveling body 1 from lifting up, on the basis of detection information of a predetermined sensor that detects the state of the attachment. Then, the controller 30 calculates the upper limit movement velocity Vlim and the upper limit movement acceleration αlim of the bucket cylinder 9 so that the calculated overturning moment falls below the restraining moment.

Accordingly, the controller 30 can calculate the upper limit values of the movement velocity and the movement acceleration of the bucket cylinder 9 so as to be able to restrain the shovel 100 from overturning.

According to the embodiments described above, a shovel capable of reducing an unstable phenomenon that could occur with the body of the shovel during aerial motion of the attachment according to motions of the shovel can be provided.

Although the embodiments for carrying out the present invention have been described in detail above, the present invention is not limited to such specific embodiments, and can be modified and changed in various manners without departing from the scope of the claimed subject matter.

In the embodiment and the modified embodiments explained above, the shovel 100 is configured to hydraulically drive all of various kinds of motion elements such as the lower traveling body 1, the upper turning body 3, the boom 4, the arm 5, the bucket 6, and the like. However, some of them may be configured to be electrically driven. In other words, the configuration and the like disclosed in the above embodiment may be applied to a hybrid shovel, an electric shovel, and the like.

What is claimed is:

1. A shovel comprising:

a lower traveling body:

an upper turning body turnably mounted on the lower traveling body;

an attachment including a boom attached to the upper turning body, an arm attached to an end of the boom, and an end attachment attached to an end of the arm;

an arm cylinder configured to drive the arm;

a hydraulic pump configured to supply hydraulic oil to the arm cylinder;

a relief valve configured to release a pressure of the hydraulic oil in a rod-side oil chamber of the arm cylinder; and a hardware processor configured to correct a motion of the arm or the end attachment according to a stability of a body of the shovel during aerial motion of the attachment, wherein the hardware processor is configured to, in a case of correcting the motion of the arm, correct the motion of the arm to move the arm in a closing direction, in response to identifying a predetermined motion of the shovel that causes the body of the shovel to be in an unstable state, the hardware processor is configured to, in response to identifying the predetermined motion of the shovel, cause the relief valve to release the pressure in the rod-side oil chamber of the arm cylinder by discharging the hydraulic oil in the rod-side oil chamber of the arm cylinder to a hydraulic oil tank, to allow the arm to be moved in the closing direction by a weight of the arm during the aerial motion of the attachment, a stable range of the attachment where a degree of static stability of the attachment is more than or equal to a predetermined reference is defined around the shovel, the stable range is an area surrounding the lower traveling body in a plane in which the lower traveling body is positioned, and an outer edge of the stable range is spaced apart from the lower traveling body, and the hardware processor is configured to determine whether a position of the end attachment relative to the lower traveling body is beyond the outer edge of the stable range, and to determine that the body of the shovel is in a static unstable state in response to determining that the position of the end attachment relative to the lower traveling body is beyond the outer edge of the stable range.

2. The shovel according to claim 1, wherein the hardware processor is configured to move the arm and the end attachment according to an operation content or a motion instruction of an automatic drive function when the body is in a stable state, and correct the motion of the arm or the end attachment in such a manner as to recover the stability compared with the motion according to the operation content or the motion instruction when the body is in an unstable state including the static unstable state.

3. The shovel according to claim 1, wherein the hardware processor is configured to move the arm in the closing direction so as to reduce a possibility of a dynamic moment exerted on the body including the lower traveling body and the upper turning body, in response to identifying the predetermined motion of the shovel.

4. The shovel according to claim 3, wherein the predetermined motion includes: a motion in which the attachment unloads an object loaded in a bucket serving as the end attachment; a motion in which the lower traveling body rapidly decelerates while the lower traveling body is traveling with the attachment being oriented in a traveling direction: or a motion of increasing an amount of a forward tilt of the body while the lower traveling body is traveling with the attachment being oriented in the traveling direction, or includes two or more thereof.

5. The shovel according to claim 1, wherein the hardware processor is configured to move the arm in the closing direction so as to reduce a change in a static moment exerted on the body including the lower traveling body and the upper turning body.

6. The shovel according to claim 5, wherein the predetermined motion includes: a lowering motion for lowering the boom while a distance between the end attachment and the body is more than a predetermined threshold value; a motion in which the attachment loads and raises a target object on a bucket serving as the end attachment: a motion of turning the upper turning body so that a direction of the attachment moves away from a traveling direction of the lower traveling body: or a motion in which an amount of forward tilt of the body increases while the lower traveling body is traveling with the attachment being oriented in the traveling direction, or includes two or more thereof.

7. The shovel according to claim 1, wherein the hardware processor is configured to slow an opening motion of the end attachment in response to determining that there is a possibility or an occurrence of a lift of a rear part of the lower traveling body.

8. The shovel according to claim 7, wherein the hardware processor is configured to slow the opening motion of the end attachment in response to determining that a weight of the end attachment is larger than a predetermined value, or in response to determining that a distance between the position of the end attachment and the lower traveling body is more than a predetermined threshold value.

9. The shovel according to claim 7, wherein the end attachment is a bucket, and the hardware processor is configured to slow an opening motion of the bucket when the attachment makes a movement of unloading an object loaded in the bucket.

10. The shovel according to claim 9, wherein the hardware processor is configured to slow the opening motion of the bucket in response to determining that a distance between a position of the bucket and the lower traveling body is more than a predetermined threshold value when the attachment makes the movement of unloading.

11. The shovel according to claim 9, wherein the hardware processor is configured to slow the opening motion of the bucket in response to determining that there is the possibility or the occurrence of the lift of the rear part of the lower traveling body when the attachment makes the movement of unloading.

12. The shovel according to claim 7, further comprising:

an end attachment cylinder configured to drive the end attachment, wherein the hydraulic pump is configured to supply the hydraulic oil to the end attachment cylinder, and the hardware processor is configured to slow the opening motion of the end attachment by: limiting a discharge flowrate of the hydraulic pump supplying the hydraulic oil to the end attachment cylinder; causing a control valve configured to control a flowrate of the hydraulic oil supplied from the hydraulic pump to the end attachment cylinder to limit the flowrate of the hydraulic oil to the end attachment cylinder; or causing a throttle valve provided in a hydraulic path between the control valve and the end attachment cylinder to reduce a flowrate of the hydraulic oil discharged from the end attachment cylinder.

13. The shovel according to claim 12, wherein the hardware processor is configured to slow the opening motion of the end attachment by limiting a movement velocity or a movement acceleration of the end attachment cylinder to a predetermined upper limit value or less or limiting both of the movement velocity or the movement acceleration to the predetermined upper limit value or less.

14. The shovel according to claim 13, further comprising:

a predetermined sensor configured to detect a state of the attachment, wherein the hardware processor is configured to calculate the predetermined upper limit value based on detection information of the predetermined sensor.

15. The shovel according to claim 14, wherein the hardware processor is configured to calculate an overturning moment in a direction to lift up the rear part of the lower traveling body and a restraining moment in a direction to restrain lifting up of the rear part of the lower traveling body based on the detection information of the predetermined sensor, and to calculate the predetermined upper limit value so that the overturning moment falls below the restraining moment.

16. The shovel according to claim 1, wherein the end attachment is a bucket, the hardware processor is configured to correct the motion of the arm to move the arm in the closing direction while the bucket is opening during the aerial motion of the attachment, and the hardware processor is configured to slow an opening of the bucket while moving the arm in the closing direction.

17. The shovel according to claim 16, further comprising:

a bucket cylinder configured to drive the bucket, wherein the hardware processor is configured to slow the opening of the bucket by limiting a movement acceleration of the bucket cylinder to an upper limit movement acceleration.

18. The shovel according to claim 17, wherein the hardware processor is configured to slow the opening of the bucket by further limiting a movement velocity of the bucket cylinder to an upper limit movement velocity after limiting the movement acceleration of the bucket cylinder to the upper limit movement acceleration.

19. The shovel according to claim 1, wherein the hydraulic pump is a variable displacement hydraulic pump and is configured to supply the hydraulic oil to the rod-side oil chamber of the arm cylinder, and the relief valve is configured to discharge the hydraulic oil in the rod-side oil chamber of the arm cylinder supplied by the hydraulic pump.

20. The shovel according to claim 1, wherein the outer edge of the stable range is defined by a first side, a second side, a third side, and a fourth side, the first side curving toward a front side of the lower traveling body, the second side curving toward a rear side of the lower traveling body, the third side curving toward a left side of the lower traveling body, the fourth side curving toward a right side of the lower traveling body.

* * * * *